US007993091B2

(12) United States Patent
Osanai et al.

(10) Patent No.: US 7,993,091 B2
(45) Date of Patent: Aug. 9, 2011

(54) WORKING MACHINE

(75) Inventors: Masashi Osanai, Hiratsuka (JP); Matsuo Nose, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 611 days.

(21) Appl. No.: 10/566,484

(22) PCT Filed: Jul. 29, 2004

(86) PCT No.: PCT/JP2004/010855

§ 371 (c)(1),
(2), (4) Date: Jan. 30, 2006

(87) PCT Pub. No.: WO2005/012653

PCT Pub. Date: Feb. 10, 2005

(65) Prior Publication Data

US 2006/0291987 A1 Dec. 28, 2006

(30) Foreign Application Priority Data

Jul. 30, 2003 (JP) ..... 2003-282974

(51) Int. Cl.
*B66C 23/00* (2006.01)

(52) U.S. Cl. ..... 414/697; 414/685

(58) Field of Classification Search ..... 414/685, 414/700, 706, 708, 697
See application file for complete search history.

(56) References Cited

U.S. PATENT DOCUMENTS 2,876,921 A * 3/1959 Salna ..... 414/700
2,926,799 A 3/1960 Granryd
2,959,306 A 11/1960 Kampert
3,274,710 A 9/1966 Wright
3,321,215 A * 5/1967 Kampert ..... 280/425.1
3,411,647 A 11/1968 Zimmerman
4,154,349 A 5/1979 Christensen
5,201,235 A * 4/1993 Sutton ..... 74/105
5,501,570 A * 3/1996 Mozingo ..... 414/700

(Continued)

FOREIGN PATENT DOCUMENTS

DE 29 48 480 A1 6/1981

(Continued)

OTHER PUBLICATIONS

Japanese Office Action dated Aug. 5, 2008 and English translation thereof issued in counterpart Japanese Appln. No. 2005-512516.
"Construction Machinery Photo Collection", Japan Industrial Publishing Co., Ltd., Feb. 15, 1970.

(Continued)

*Primary Examiner* — Donald Underwood
(74) *Attorney, Agent, or Firm* — Holtz, Holtz, Goodman & Chick, PC

(57) ABSTRACT

In a wheel loader 3, an angle formed by a first line segment L1 connecting a pivot position Y on a boom 10 of a bell crank 11 and a pivot position X on a connecting link 13 and a second line segment L2 connecting the pivot position Y on the boom 10 of the bell crank 11 and a pivot position W on a tilt cylinder 12 is set in a range from 0 degree to 180 degrees on the attachment 20, 30 side, the attachment can be selected from a plurality of types such as a bucket 20 and a fork 30 for use, and each of the attachment 20, 30 that is different from each other has a different pivot position on the connecting link 13 relative to the pivot position on the boom 10 as a reference point.

3 Claims, 42 Drawing Sheets

U.S. PATENT DOCUMENTS 6,309,171 B1 10/2001 Arck et al.

FOREIGN PATENT DOCUMENTS

| | | | |
|---|---|---|---|
| FR | 1 523 548 | A | 5/1968 |
| FR | 2 727 998 | A1 | 6/1996 |
| JP | 43-1693 | A | 1/1943 |
| JP | 63-22499 | A | 1/1988 |
| JP | 01-295922 | A | 11/1989 |
| JP | 06-010287 | U | 2/1994 |
| JP | 06-293498 | A | 10/1994 |
| JP | 2838251 | B2 | 12/1998 |
| JP | 11-343631 | A | 12/1999 |

OTHER PUBLICATIONS

U.S. Appl. No. 11/814,903, filed Jul. 26, 2007, entitled: Work Machine, inventor: M. Osanai.

Supplementary European Search Report (SESR) dated Mar. 11, 2011 (in English) in counterpart European Application No. 04748066.0.

* cited by examiner

WORKING MACHINE

This application is a U.S. National Phase Application under 35 USC 371 of International Application PCT/JP2004/010855 filed Jul. 29, 2004.

TECHNICAL FIELD

The present invention relates to a working machine.

BACKGROUND ART

Conventionally, a wheel loader is known as a working machine. In a wheel loader, an attachment such as a bucket or the like is provided at an end of a boom pivoted on a vehicle body, and the boom is provided in a manner movable up and down by a boom cylinder, and the bucket is driven via a Z-bar link.

The Z-bar link includes, as shown in FIG. 35, a bell crank 11 turnably pivoted on a substantially central portion of the boom 10, a tilt cylinder (refer to chain lines) connecting an end of the bell crank 11 and the vehicle body (not shown), and a connecting link 13 for connecting the other end of the bell crank 11 and a back side of the bucket 20.

Incidentally, in FIG. 35, the boom cylinder and the tilt cylinder are not shown to simplify the figure. In addition, although the pivoted position Z of the tilt cylinder on the vehicle body (pivot position) is drawn on the boom 10 in the figure, the actual pivot position is on the vehicle body (not shown), not on the boom 10. In FIG. 35, postures of the bucket 20 at a ground position, an intermediate position, and a top position are shown.

In the wheel loader having such configuration, the bucket 20 is positioned close to the ground position to perform digging work, and to the intermediate position or the top position to dump onto a truck therefrom.

Besides the digging work, the wheel loader may be used to scoop mud, animal waste or the like. In this case, as shown in FIG. 36, the bucket 20 is tilted at the ground position so that the mud or the like having fluidity is not spilt, thereby efficiently performing the scooping work.

As the wheel loader, a wheel loader having improved angular characteristics in which the pivot position of the tilt cylinder on the vehicle body is set at a prespecified position and thereby an attachment angle is kept substantially constant from the ground position to the top position of the bucket is also known (for instance, Patent document 1).

Movements in this configuration are simplifiedly drawn in FIG. 9.

Further, there has been also known that the bell crank constituting the Z-bar link is tilted toward the attachment side (for instance, Patent document 2).

Concretely, as shown in FIG. 37 and FIG. 38, relative to a line L1 connecting a pivot position Y on the boom 10 and a pivot position X on the connecting link 13, a line L2 connecting a pivot position W on the tilt cylinder 12 and the pivot position Y of the bell crank 11 of the wheel loader is inclined toward the bucket 20 side.

In addition, a wheel loader in which a fork is combined with the Z-bar link is also known (for instance, Patent document 3).

As shown in FIG. 39, according to this wheel loader, the bucket 20 may be replaced with the fork 30, and when replacing, the tilt cylinder (not shown) is a little extended so that the fork 30 can be attached. Namely, the extension amount of the tilt cylinder is, as shown in the chain double-dashed line, equivalent to an offset angle $\alpha$ of the bucket 20, and the fork 30 is attached to the connecting link 13 at this position.

Accordingly, even in the wheel loader using the Z-bar link, the attachment angle from the ground position to the top position is kept substantially constant, where the angle characteristics is improved, so that work using the fork 30 can be performed.

On the other hand, as another configuration of the wheel loader, there is a parallel link type as shown in FIG. 40. In the parallel link configuration, a lower end of a tilt lever 19 (a lower end in the state shown in the figure) is pivoted on the boom 10, the connecting link 13 is attached so that an upper end of the tilt lever 19 and a back side of the fork 30 are connected, and the tilt cylinder 12 is attached so that an intermediate portion of the tilt lever 19 and the vehicle body (refer to the chain double-dashed line) are connected, and thereby, the boom 10 and the connecting link 13 are disposed in parallel to each other.

With the wheel loader using the parallel link, even when the boom 10 is rotated upward, since a posture of the fork 30 can be kept constant without changing the advancement and retraction amount of the tilt cylinder 12, transporting and lifting/unloading work of cargos can be stably performed.

Patent document 1: Japanese Patent Laid-Open Publication No. HEI 11-343631

Patent document 2: U.S. Pat. No. 4,154,349; specification

Patent document 3: Japanese Patent Laid-Open Publication No. SHO 63-22499

DISCLOSURE OF THE INVENTION

Problems to be Solved by the Invention

In the wheel loader disclosed in Patent document 1, the angle characteristics of the bucket is improved by specifying the pivot position of the tilt cylinder on the vehicle body, but when the bucket is tilted at the ground position for scooping mud or the like with fluidity, if the bucket is lifted upward by rotating the boom, the attachment angle at the top position is considerably displaced toward the plus side (the other side of the dumping side), where the angle characteristics is not be kept, which is disadvantageous.

This disadvantage also occurs not only in the conventional wheel loader shown in FIG. 35 in the same manner as shown in FIG. 36, but in the wheel loader of Patent document 2 shown in FIG. 37 in the same manner as shown in FIG. 38. Especially in the wheel loader disclosed in Patent document 2 (FIG. 37, FIG. 38), the tilt cylinder (refer to the chain line) is pivoted on the boom 10, which is different from other types of wheel loaders, so that even when the boom 10 is rotated, a positional relation with the tilt cylinder does not change at all, therefore regardless of whether the bucket 20 is tilted at the ground position or not, the attachment angle is considerably displaced toward the plus side while the bucket 20 is being lifted, resulting in that the mud or the like scooped into the bucket 20 is spilt onto the vehicle side badly as being lifted up to the top position.

An object of the present invention (a first object of the present invention) is to provide a working machine that has improved angle characteristics both in a case where a tilt cylinder is operated so that a bucket is horizontal at the ground position and where the bucket is tilted.

Patent document 3 discloses that the fork 30 is attached to the Z-bar link, but the wheel loader using the Z-bar link is generally inferior in the tilting force characteristics at the top position compared with the wheel loader using the parallel link, and therefore the wheel loader using the Z-bar link is not suitable for performing lifting/unloading work of cargos (the tilting force characteristics is a tilting force of the tilt cylinder).

Concretely, FIG. 41 shows the tilting force characteristics of the tilt cylinder 12 of the wheel loader using the conventional Z-bar link and using the parallel link. In the figure, the vertical axis indicates a lifting height (a height of the bucket 20 or the fork 30), while the horizontal axis indicates a tilting force thereof.

It is understood from the figure that, in case of the wheel loader using the Z-bar link, the maximum tilting force is obtained at the ground position where the lifting height is small, so that the wheel loader using the Z-bar link is suitable for digging work using the bucket 20. On the other hand, in case of the wheel loader using the parallel link, it is understood that the tilting force does not decrease sharply from the ground position to the top position, so that the wheel loader using the parallel link is suitable for lifting/unloading work of cargos using the fork 30.

Hence, in the technology disclosed in Patent document 3 where the fork 30 is simply attached to the Z-bar link, no improvement in the tilting force characteristics is obtained, resulting that even if the bucket 20 is replaced with the fork 30 for performing lifting/unloading work of cargos or the like, the tilting force is insufficient, so that actually the work can hardly be performed.

Another object of the present invention (a second object of the present invention) is to provide a working machine in which even when a Z-bar link is used, a fork can be used by improving tilting force characteristics.

FIG. 42 shows the angle characteristics of the conventional wheel loader using the Z-bar link (FIG. 35, FIG. 36) and of the wheel loader using the parallel link (FIG. 40). In FIG. 42, the vertical axis indicates the lifting height thereof, while the horizontal axis indicates an attachment angle that represents horizontal displacement. The attachment angle is regarded to be zero degree at the position where the attachment is horizontally attached on the ground.

As is clear from the figure, the wheel loader using the parallel link causes less changes in the attachment angle and is suitable for performing work with the fork 30 from which cargos should never fall.

Conventionally, according to the features shown in FIG. 42 and above-described FIG. 41, the wheel loader having the Z-bar link and the bucket 20 in combination is generally used for digging work, while the wheel loader having the parallel link and the fork 30 in combination is generally used for lifting/unloading work, i.e. the two types of the wheel loaders are prepared and used depending on work type.

However, it is not economical that the two types of the wheel loaders need to be prepared. Hence, as disclosed in Patent document 3, a wheel loader that can perform any type of work by exchanging the bucket 20 and the fork 30 is proposed, but there is a problem relating to the tilting force as described above.

According to Patent document 3, by offsetting the attachment position of the fork 30 to the connecting link 13 relative to the case of the bucket 20, only the angle characteristics in the case where the fork 30 is attached is improved, so that the angle characteristics when using the bucket 20 is sacrificed. Namely, as shown in FIG. 39, when the boom 10 is rotated and moved to the top position with the bucket 20 attached, the bucket 20 is dumped more badly as reaching a higher position, representing a problem that the angle characteristics is very poor.

Still another object of the present invention (a third object of the present invention) is, in addition to the above-described second object, to provide a working machine in which both of excellent characteristics of a Z-bar link and a parallel link can be obtained with a single link mechanism, where an attachment such as a bucket, a fork or the like can be appropriately selected for use.

Incidentally, Patent document 1 only discloses that the angle characteristics of the bucket 20 is improved by adjusting the pivot position of the tilt cylinder 12, while Patent document 2 only discloses the bell crank inclined toward the bucket side, where no description about replacing the bucket 20 with the fork 30 for use or the tilting force characteristics is provided in Patent documents 1 and 2.

Means for Solving the Problems

A working machine according to a first embodiment of the present invention includes:

a boom of which one end is attached to a structural body supporting a work implement;

a bucket or the like attached as an attachment to the other end of the boom;

a bell crank attached to a middle position of the boom in a longitudinal direction thereof;

a tilt cylinder for driving the bell crank; and a connecting link for connecting the bell crank and the bucket or the like, in which when the bucket or the like is horizontally at a ground position and a digging face of the bucket or the like is opposing to a ground surface, the tilt cylinder drives the bell crank on an upper end side thereof and the connecting link connects the bell crank to the bucket or the like on a lower end side of the bell crank;

the tilt cylinder connects the bell crank and the structural body; and an angle between a first line segment connecting a pivot position on the boom and a pivot position on the connecting link of the bell crank and a second line segment connecting the pivot position on the boom and a pivot position on the tilt cylinder of the bell crank is set in a range from 0 degrees to 180 degrees on the bucket or the like side.

A working machine according to a second embodiment of the present invention includes:

a boom of which one end is attached to a structural body supporting a work implement;

a fork or the like attached as an attachment to the other end of the boom;

a bell crank attached to a middle position of the boom in a longitudinal direction thereof;

a tilt cylinder for driving the bell crank; and a connecting link for connecting the bell crank and the fork or the like, in which when the fork or the like is horizontally at a ground position, the tilt cylinder drives the bell crank on an upper end side thereof and the connecting link connects the bell crank to the fork or the like on a lower end side of the bell crank; and an angle between a first line segment connecting a pivot position on the boom and a pivot position on the connecting link of the bell crank and a second line segment connecting the pivot position on the boom and a pivot position on the tilt cylinder of the bell crank is set in a range from 0 degrees to 180 degrees on the fork or the like side.

A working machine according to a third embodiment of the present invention includes:

a boom of which one end is attached to a structural body supporting a work implement;

a fork or the like attached as an attachment to the other end of the boom;

a bell crank attached to a middle position of the boom in a longitudinal direction thereof;

a tilt cylinder for driving the bell crank; and a connecting link for connecting the bell crank and the fork or the like, in which when the fork or the like is horizontally at a ground position, the tilt cylinder drives the bell crank on an upper end side thereof and the connecting link connects the bell crank to the fork or the like on a lower end side of the bell crank;

the tilt cylinder connects the bell crank and the structural body; and an angle between a first line segment connecting a pivot position on the boom and a pivot position on the connecting link of the bell crank and a second line segment connecting the pivot position on the boom and a pivot position on the tilt cylinder of the bell crank is set in a range from 0 degrees to 180 degrees on the fork or the like side.

A working machine according to a fourth embodiment of the present invention includes:

a boom of which one end is attached to a structural body supporting a work implement;

an attachment attached to the other end of the boom;

a bell crank attached to a middle position of the boom in a longitudinal direction thereof, a tilt cylinder for driving the bell crank; and a connecting link for connecting the bell crank and the attachment, in which when the attachment is horizontally at a ground position, the tilt cylinder drives the bell crank on an upper end side thereof and the connecting link connects the bell crank to the attachment on a lower end side of the bell crank;

an angle between a first line segment connecting a pivot position on the boom and a pivot position on the connecting link of the bell crank and a second line segment connecting the pivot position on the boom and a pivot position on the tilt cylinder of the bell crank is set in a range from 0 degrees to 180 degrees on the attachment side;

the attachment may be selected for use from a plurality of types; and each of the attachment that is different from each other has a different pivot position on the connecting link relative to the pivot position on the boom as a reference point.

A working machine according to a fifth embodiment of the present invention includes:

a boom of which one end is attached to a structural body supporting a work implement;

an attachment attached to the other end of the boom;

a bell crank attached to a middle position of the boom in a longitudinal direction thereof;

a tilt cylinder for driving the bell crank; and a connecting link for connecting the bell crank and the attachment, in which when the attachment is horizontally at a ground position, the tilt cylinder drives the bell crank on an upper end side thereof and the connecting link connects the bell crank to the attachment on a lower end side of the bell crank;

the tilt cylinder connects the bell crank and the structural body;

an angle between a first line segment connecting a pivot position on the boom and a pivot position on the connecting link of the bell crank and a second line segment connecting the pivot position on the boom and a pivot position on the tilt cylinder of the bell crank is set in a range from 0 degrees to 180 degrees on the attachment side;

the attachment may be selected for use from a plurality of types; and each of the attachment that is different from each other has a different pivot position on the connecting link relative to the pivot position on the boom as a reference point.

Any of the foregoing embodiments of the working machine may be constructed such that the pivot position of the tilt cylinder on the structural body is lower compared to the pivot position of the boom on the structural body.

Any of the foregoing embodiments of the working machine may be constructed such that the angle between the first line segment and the second line segment is set so that the angle is equal to or smaller than an angle at which absolute values of the attachment angles of the attachment are substantially equal to each other at any two positions from the ground position to the top position of the attachment.

Any of the foregoing embodiments of the working machine may be constructed such that the angle between the first line segment and the second line segment is in a range from 0 degrees to 170 degrees.

Any of the foregoing embodiments of the working machine may be constructed such that the angle between the first line segment and the second line segment is in a range from 170 degrees to 180 degrees.

Effect of the Invention

According to the first embodiment of the working machine, an end of the tilt cylinder is attached to a bell crank and the other end of the tilt cylinder is attached not to a boom but to a structural body supporting a work implement, and an angle formed by a first line segment and a second line segment of the bell crank is set in the range from 0 degrees to 180 degrees on the bucket or the like side so that the displacement of the attachment angle from the ground position to the top position in a horizontal or tilted posture of the bucket or the like on the ground position is smaller compared with that of the conventional configuration using the Z-bar link (FIG. 35, FIG. 36) or the configurations disclosed in Patent documents 1, 2 (FIG. 37, FIG. 38), thereby improving the angle characteristics.

Therefore, the angle characteristics can be improved both in the case where the tilt cylinder is operated so that the bucket or the like is horizontal at the ground position and where the bucket or the like is tilted, so that the first object of the present invention is achieved.

According to the second embodiment of the working machine, the configuration using the so-called Z-bar link is employed, and since the angle formed by the first line segment and the second line segment of the bell crank is set in the range from 0 degrees to 180 degrees on the fork or the like side, the ratio of an effective length in the upper portion of the bell crank between the ground position and the top position becomes larger, so that the tilting force at the top position becomes larger, where the tilting force characteristics is improved compared with the case of the technology disclosed in Patent document 3 in which the bucket is replaced with the fork by using the bell crank inclined toward the vehicle body side, and therefore the tilting force characteristics appropriate for use of the fork can be obtained.

Thus, by improving the tilting force characteristics, the fork can be used, where the second object of the present invention can be achieved.

According to the first embodiment of the working machine, in addition to the configuration of the second embodiment of the working machine, since the tilt cylinder is disposed so that the bell crank and the structural body are connected, setting for reducing the displacement of the attachment angle of the fork or the like is allowed, thereby improving the angle characteristics, so that the angle characteristics more appropriate for use of the fork or the like can be obtained.

According to the fourth embodiment of the working machine, each type of attachment has a different pivot position on the connecting link relative to the pivot position on the boom, and when the attachment is attached to the connecting link, for instance, at a position where the bell crank is rotated toward the tilting side, the pivot position is offset to the side apart from the attachment, so that the tilting force at the top position is considerably increased.

Further, in the second embodiment of the invention, by setting the angle formed by the first line segment and the second line segment of the bell crank in the range from 0 degrees to 180 degrees on the attachment side, the tilting force can be improved. Hence, for instance, when the fork or the like is attached at the offset position in replacement of the bucket or the like, not only greater tilting force characteristics can be obtained on the top position side compared with that in the technology of Patent document 3, but also the tilting force characteristics equivalent to the conventional parallel link can be obtained during the use of the Z-bar link, so that the lifting/unloading work or the like can be properly performed.

Thus, the second object can be achieved.

When attaching the bucket or the like, since the bucket or the like is to be attached without offsetting, the tilting force characteristics on the ground position side is kept appropriate in a conventional manner, where the digging work or the like can be appropriately performed.

Since the angle formed by the first line segment and the second line segment of the bell crank is set in the range from 0 degrees to 180 degrees, for instance, attaching the fork or the like at the offset position at the ground position can be regarded as equivalent to attaching the bucket or the like in the tilted posture as in the first embodiment of the working machine, and even when compared with the case where the bucket or the like is attached without being offset (tilted) at the ground position, the difference in the angle characteristics from the ground position to the top position of each case is small.

Namely, in the cases of using the bucket or the like without offsetting and of attaching the fork or the like at the offset position, both angle characteristics are improved to a same level as the parallel link. Therefore, particularly in the case where the bucket or the like is attached, badly dumping does not occur at the top position unlike the case of the technology in Patent document 3.

Consequently, the excellent characteristics of the Z-bar link and the parallel link can be obtained only by the Z-bar link, where the attachment can be appropriately selected from the bucket, the fork or the like for use, thereby achieving the third object of the present invention.

According to the fifth embodiment of the working machine, in addition to the configuration of the fourth embodiment of the invention, the tilt cylinder is disposed so that the bell crank and the structural body are connected, setting for reducing the displacement of the attachment angle of the fork or the like from the ground position to the top position is possible, thereby improving the angle characteristics.

The angle characteristics of the attachment can be improved by adding to the first, third and fifth embodiments of the working machine, a configuration in which the pivot position of the tilt cylinder on the structural body is set lower than the pivot position of the boom on the structural body.

In other embodiments of the working machine, when the bucket or the like is tilted for use at the ground position, the angle formed by the first line segment and the second line segment of the bell crank is to be set to a value so that, for instance, the displacement amount toward the dumping side (the displacement amount toward the plus side) of the bucket or the like at the intermediate position and the displacement toward the structural body side (the displacement amount toward the minus side) of the bucket or the like at the top position are equal (i.e. the absolute values of the attachment angles relative to the horizontal posture are equal), and thereby there is no risk that the bucket or the like is considerably displaced toward the dumping side or the structural body side, where the scooping work of mud or the like can be appropriately performed.

And when equal to or less than such angle between the first line segment and the second line segment of the bell crank, for instance, the displacement amount between two positions, the intermediate position and the top position for instance, becomes gradually smaller and the displacement amount toward the structural body at the top position also becomes smaller, so that the mud or the like is more hardly spilt at least on the operator side, thereby the scooping work or the like can be adequately performed. However, the selected two positions are not limited to the intermediate position and the top position.

In the embodiments of the working machine in which the angle between the first line segment and the second line segment of the bell crank is set in the range from 0 degrees to 170 degrees on the attachment side, the angle characteristics and the tilting force characteristics can be assured with some surplus.

In embodiments of the working machine in which the angle between the first line segment and the second line segment of the bell crank is set to in the range from 170 degrees to 180 degrees on the attachment side, even when, relative to the pivot position of the fork or the like on the connecting link, the pivot position of the bucket or the like on the connecting link is set to an offset angle of 37 degrees or more in relation to the pivot position on the boom (the reference point), both of the fork or the like and the bucket or the like can be attached to the working machine.

EXPLANATION OF CODES

1, 2, 3, 4, 5: wheel loader as a working machine; 10: boom; 11: bell crank; 12: tilt cylinder; 13: connecting link; 16: vehicle body; 16A: structural body; 20: bucket (bucket or the like, attachment); 30: fork (fork or the like, attachment); L1: first line segment; L2: second line segment; P, Q, S, W, X, Y, Z: pivot position

BEST MODE FOR CARRYING OUT THE INVENTION

First Embodiment

A first embodiment according to the present invention will be described below with reference to the drawings.

Figure 1:
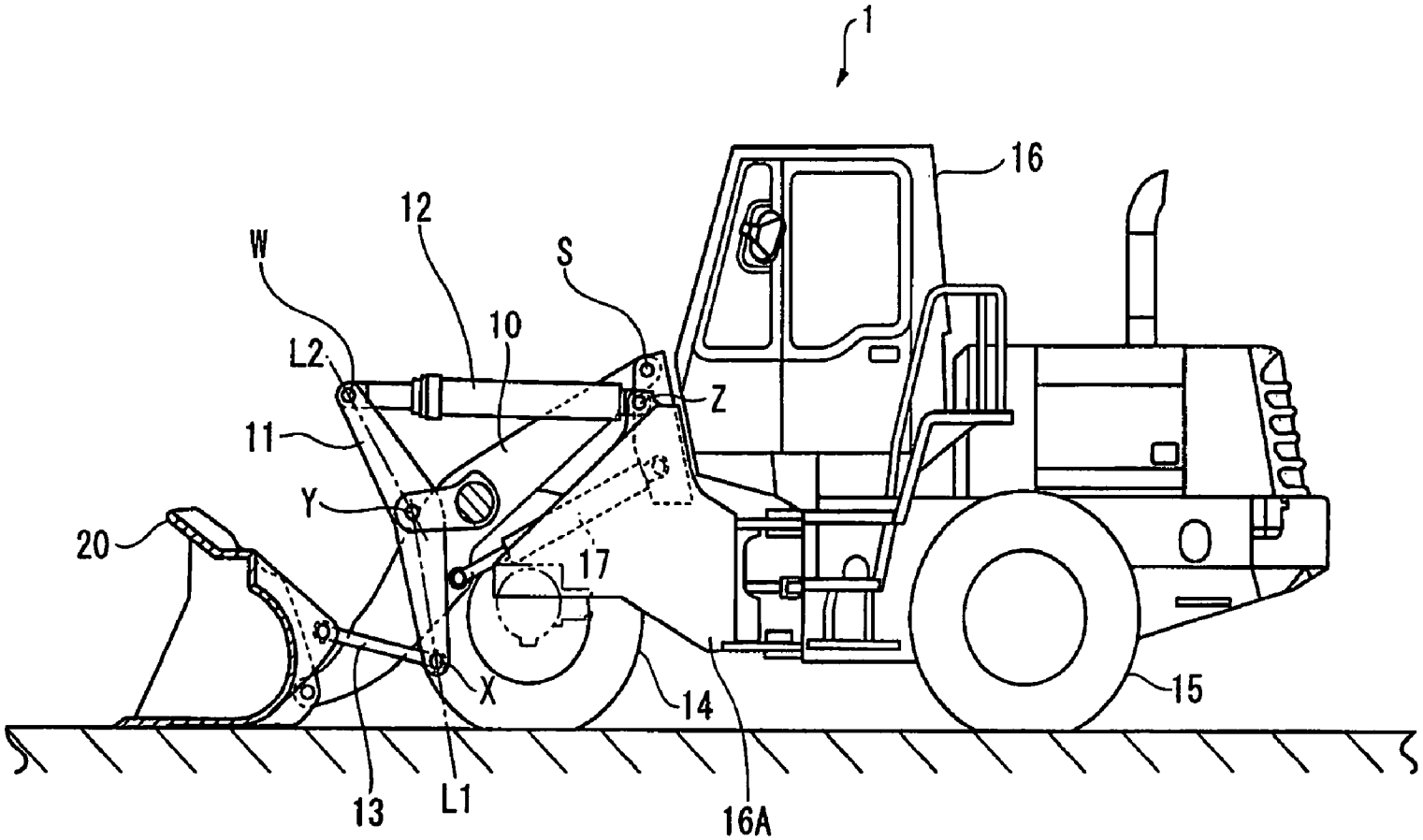
FIG. 1 is a side view showing a working machine according to a first embodiment of the present invention.
Figure 2:
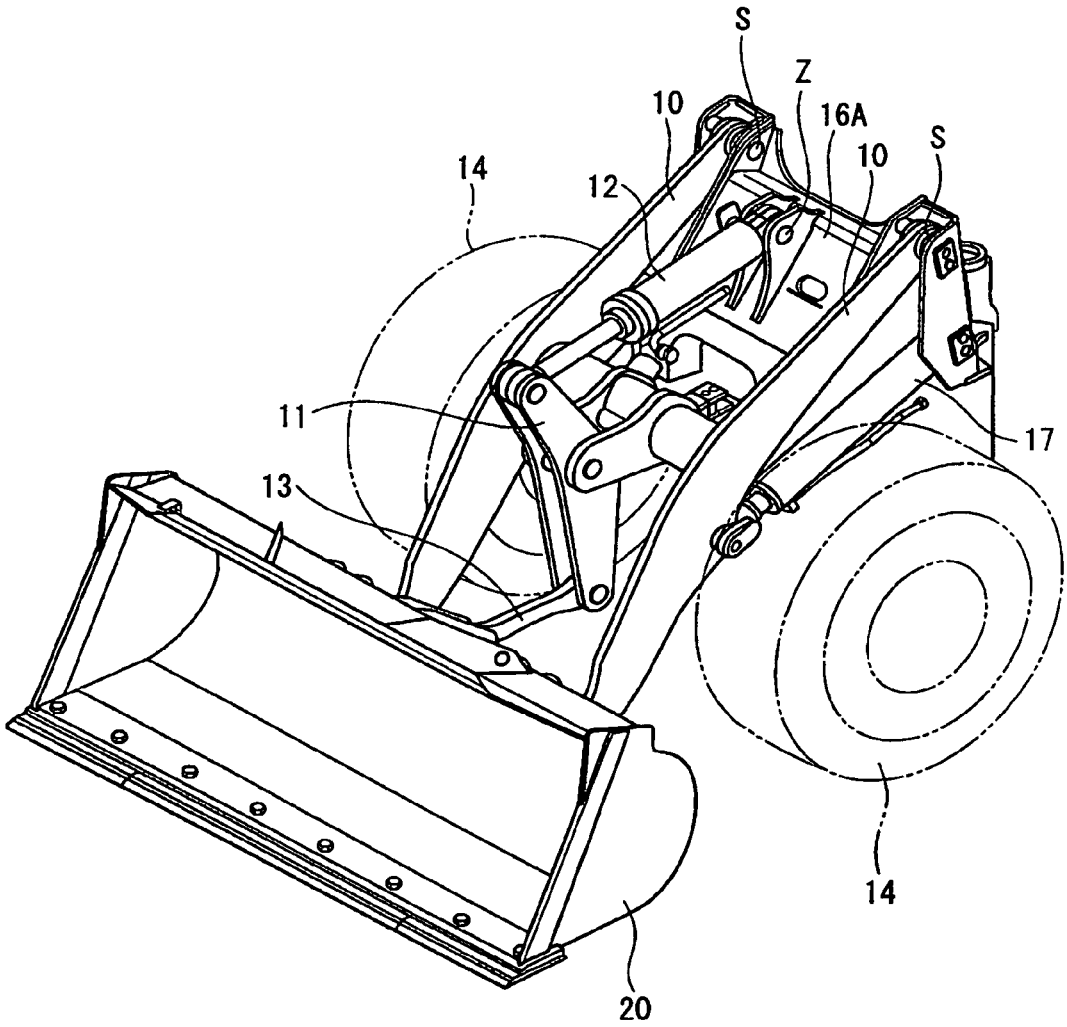
FIG. 2 is a perspective view showing a primary portion of the working machine according to the first embodiment.
Figure 3:
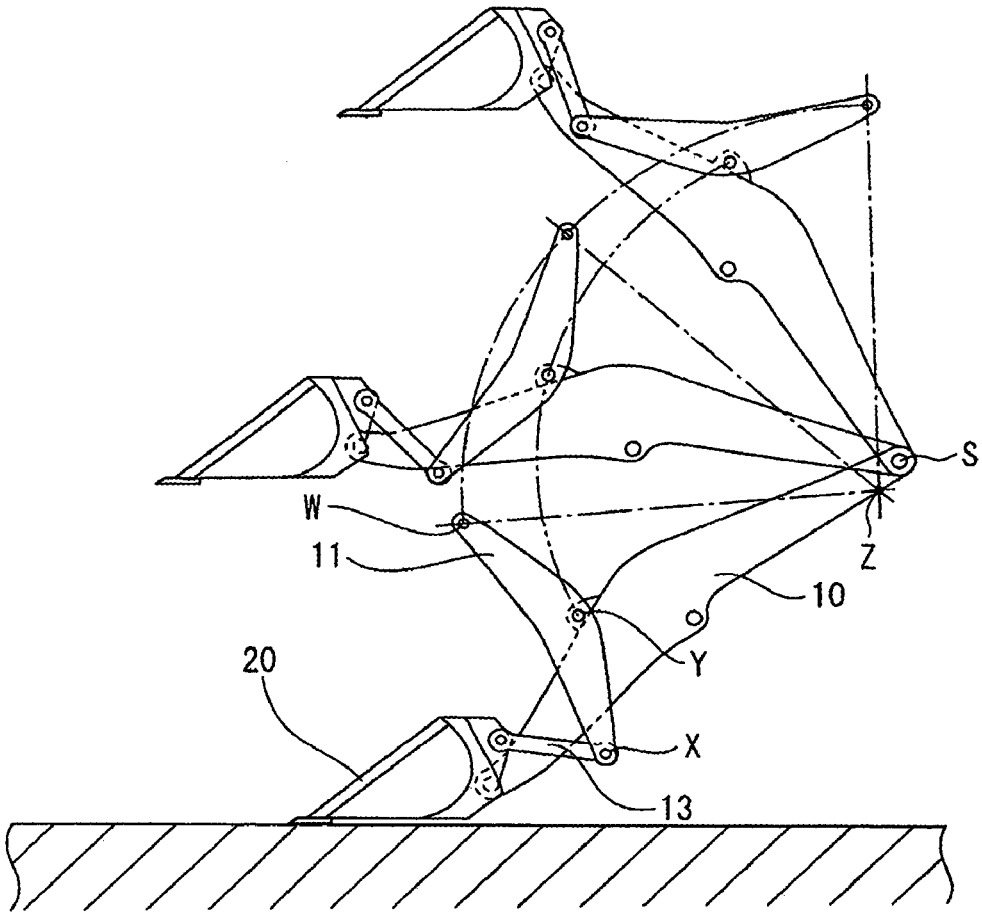
FIG. 3 is a view for illustrating movements of the first embodiment.
Figure 4:
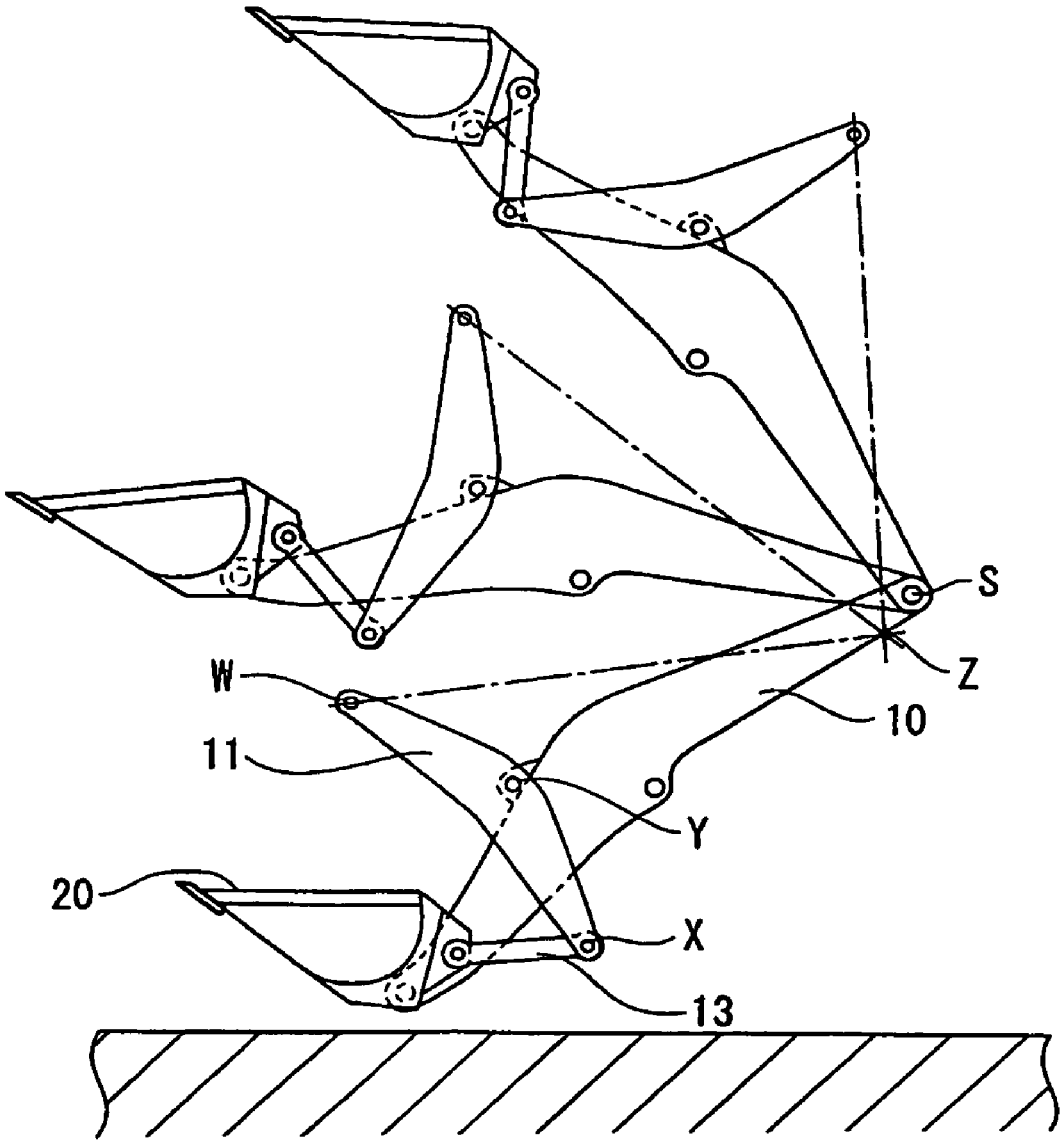
FIG. 4 is another view for illustrating the movements of the first embodiment.

FIG. 1 is a side view showing an entire wheel loader (working machine) 1 according to the present embodiment, FIG. 2 is a perspective view showing an appearance of a portion of a work implement of the wheel loader 1, and FIGS. 3 and 4 are views each showing movements of a primary portion of the wheel loader. In each figure, the same reference numerals are assigned to the same components described in the background art.

The wheel loader 1 has a self-traveling vehicle body 16 with front tires 14 and rear tires 15, a structural body 16A supporting the work implement including a bucket 20 provided in front of in the vehicle body 16 (left side in the figure), a boom 10 for driving the bucket 20 and a link mechanism of Z-bar link type.

The boom 10 is pivoted on the structural body 16A at a base end thereof and driven by a boom cylinder 17, and the bucket (bucket or the like) 20 is pivoted on a front end of the boom 10. The link mechanism of Z-bar link type includes a dogleg-shaped bell crank 11 pivoted at a halfway position in a longitudinal direction of the boom 10, a tilt cylinder 12 for driving an upper end side of the bell crank 11 (upper end side when the bucket 20 is at a ground position), and a connecting link 13 for connecting a lower end side of the bell crank 11 and the bucket 20, in which the tilt cylinder 12 is attached so that the bell crank 11 and the structural body 16A are connected.

In this configuration, the base end side of the tilt cylinder 12 is pivoted on the structural body 16A, and a pivot position Z of the tilt cylinder 12 on the structural body 16A is set to a position at which an attachment angle of the bucket 20 is not displaced between a ground position and a top position when the boom 10 is lifted, and in this embodiment the pivot position Z is set a little below of a pivot position S of the boom 10 on the structural body 16A. Thus, the angle characteristics of the bucket 20 in a horizontal state or tilted state at the ground position is improved.

On the other hand, in the wheel loader as described above, an angle formed by a first line segment L1 connecting a pivot position Y on the boom 10 and a pivot position X on the connecting link 13 and a second line segment L2 connecting a pivot position W on the tilt cylinder 12 and the pivot position Y is set in a range from 0 degree to 180 degrees on the bucket 20 side. With this feature, in the cases where the bucket 20 is set horizontal at the ground position and where the bucket 20 is tilted at the ground position (FIG. 4), displacement of the attachment angle of the bucket 20 from the ground position to the top position becomes smaller, thus also in this point, the angle characteristics is improved.

The above-described features, i.e., that the pivot position Z of the tilt cylinder 12 on the structural body 16A is placed below the pivot position S of the boom 10 on the structural body 16A; and that the second line segment L2 of the bell crank 11 is inclined toward the attachment 20 side relative to the first line segment L1, will be explained with reference to FIG. 5 (lower right). At first, the relation of an upper rotation angle of the bell crank (a rotation angle of the second line segment L2 of the bell crank 11) when the bucket 20 is horizontal at the ground position with a length of the tilt cylinder is expressed as a point T0. Similarly when the bucket 20 is at the ground position, the relation of a lower rotation angle of the bell crank (a rotation angle of the first line segment L1 of the bell crank 11) with a rotation angle of a line segment PQ (described below) is expressed as a point T1 above the point T0, and an attachment angle against G. L. when the bucket 20 is at the ground position is expressed as a point T2 to which the point T1 is moved (toward the left side), namely 0 (zero) degree.

When the bucket 20 is lifted to the top position without changing the length of the tilt cylinder 12, the upper rotation angle of the bell crank is reduced to a point T3, while the lower rotation angle of the bell crank is reduced to a point T4. In this case, the attachment angle against G. L. of the bucket 20 is 0 degree which is equal to the ground position as expressed as a point T5 with no displacement of the attachment angle, where the angle characteristics is appropriate.

Incidentally, the "rotation angle of the line segment PQ" refers to a rotation angle of a line segment connecting a pivot position P of the bucket 20 on the boom 10 (FIG. 16) and a pivot position Q of the bucket 20 on the connecting link 13 (FIG. 16), and when assuming the line segment PQ is 0 degree with the boom 10 positioned at the top position and the bucket 20 positioned in the most dumping side, the rotation angle of the line segment PQ is a relative angle when the line segment PQ is rotated around the pivot position P. The upper rotation angle and the lower rotation angle of the bell crank as described above also express relative angles when the line segments are rotated around the pivot position Y when assuming the position in the same bucket posture is 0 degree. The same interpretation is made when using a fork 30 in replacement of the bucket 20.

Next, the relation between the upper rotation angle of the bell crank and the tilt cylinder length when the bucket 20 is tilted at the ground position is expressed as a point N0. Namely, the upper rotation angle of the bell crank becomes larger by the tilted value as the tilt cylinder length becomes longer, so that the point N0 is displaced in the right-upward direction compared with the point T0.

Similarly, when the bucket 20 is at the ground position, the relation between the lower rotation angle of the bell crank and the rotation angle of the line segment PQ is expressed as a point N1 above the point N0, and further the attachment angle against G. L. with the bucket 20 being at the ground position is expressed as a point N2 to which the point N1 is moved (toward the left side), namely +25 degrees. This means that the bucket 20 is tilted by 25 degrees upward at the grand position.

Next, when the bucket 20 is lifted to the top position without changing the length of the tilt cylinder 12, the upper rotation angle of the bell crank reduces to a point N3, while the lower rotation angle of the bell crank is reduced to a point N4. In this case, the attachment angle against G. L. of the bucket 20 is +25 degrees which is equal to the ground position as expressed as a point N5, and the angle characteristics is appropriate because the tilted angle kept unchanged.

The angle characteristics with the bucket 20 tilted at the ground position varies in accordance with an inclined angle of the bell crank 11 toward the bucket 20 side, namely an inclined angle of the line segment L2 against the line segment L1. It is to be noted that the inclined angle as referred herein indicates a degree of an inclination of the line segment L2 against the line segment L1, so that an angle formed by both of the line segments L1, L2 is calculated by a formula: 180 degrees—(inclined angle).

Figure 6:
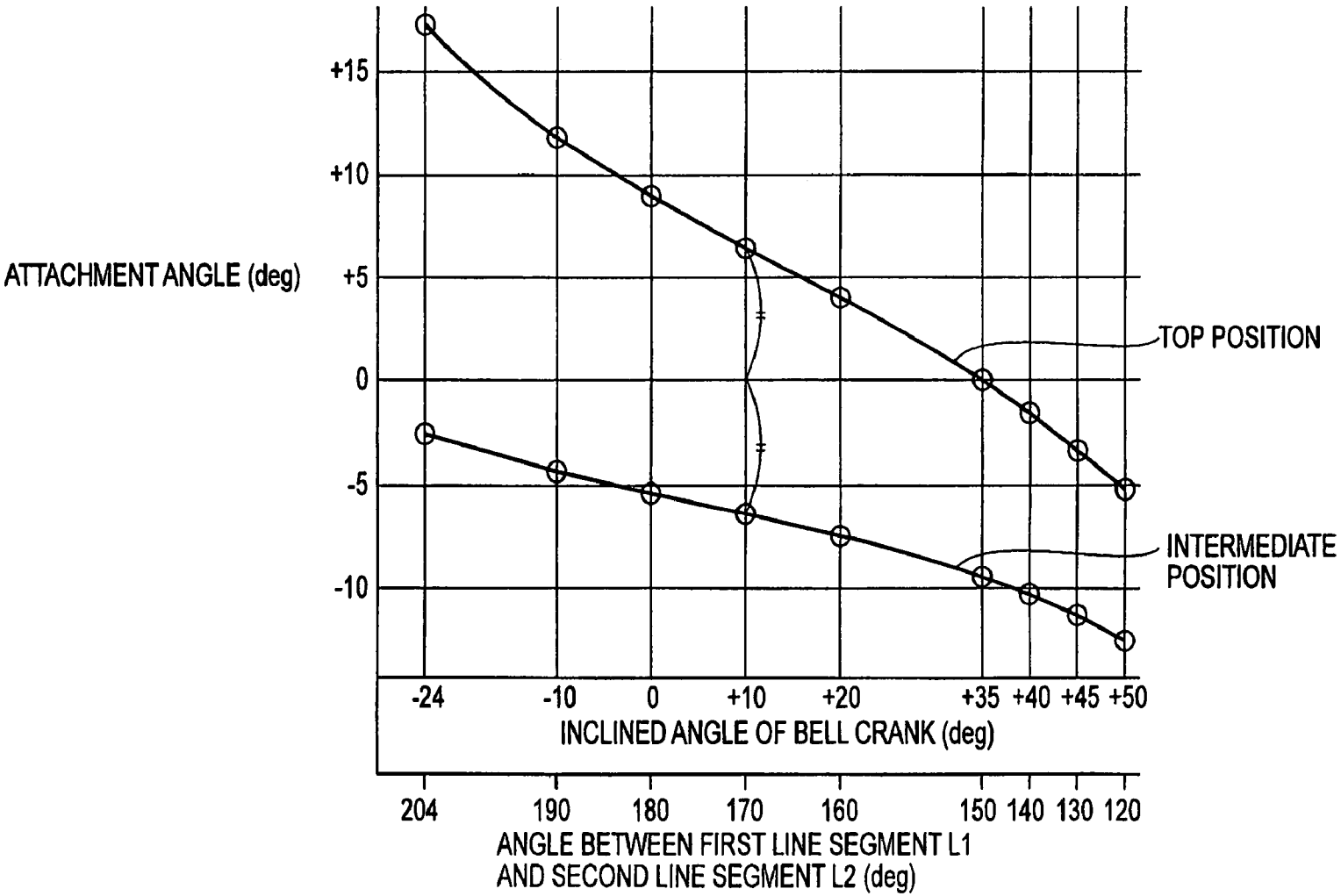
FIG. 6 is another graph for illustrating another mechanism of the first embodiment.

In FIG. 6, the horizontal axis indicates the inclined angle of the bell crank 11 toward the bucket 20 side, while the vertical axis indicates the attachment angle of the bucket 20. For the inclined angle of the bell crank 11, the minus indicates an inclination toward the vehicle body 16 side, and the plus indicates an inclination toward the bucket 20 side. As for the attachment angle, for instance, values at the intermediate position and the top position are indicated. This attachment angle is an angle relative to the ground level, where the minus indicates a displacement toward the dumping direction, while the plus indicates a displacement toward the tilting direction. From the figure, an inclined angle actually applicable to the bucket 20 in the tilted posture can be known. Tilted postures of the first embodiment shown in FIG. 9, for instance, are a case where the inclined angle in FIG. 6 is 10 degrees (170 degrees as an angle formed by the line segment L1 and the line segment L2).

From FIG. 6, when the line segment L2 on the bell crank 11 is inclined toward the vehicle body 16 side (for instance, −24 degrees in the horizontal axis), the attachment angle of the bucket 20 is close to 0 degree at the middle position with little displacement, however, the attachment angle is over +15 degrees and largely displaced toward the tilted direction at the top position. Therefore, when the bucket 20 is tilted for performing scooping work of mud or the like, the mud or the like may be spilt to the vehicle body 16 side as the bucket 20 comes closer to the top position.

In order to overcome such disadvantage, it is desirable to set the inclined angle of the second line segment L2 on the bell crank 11 toward the bucket 20 side to 10 degrees or more (although it depends on the work type). This means that the angle between the first line segment L1 and the second line segment L2 is set to 170 degrees or less.

Figure 9:
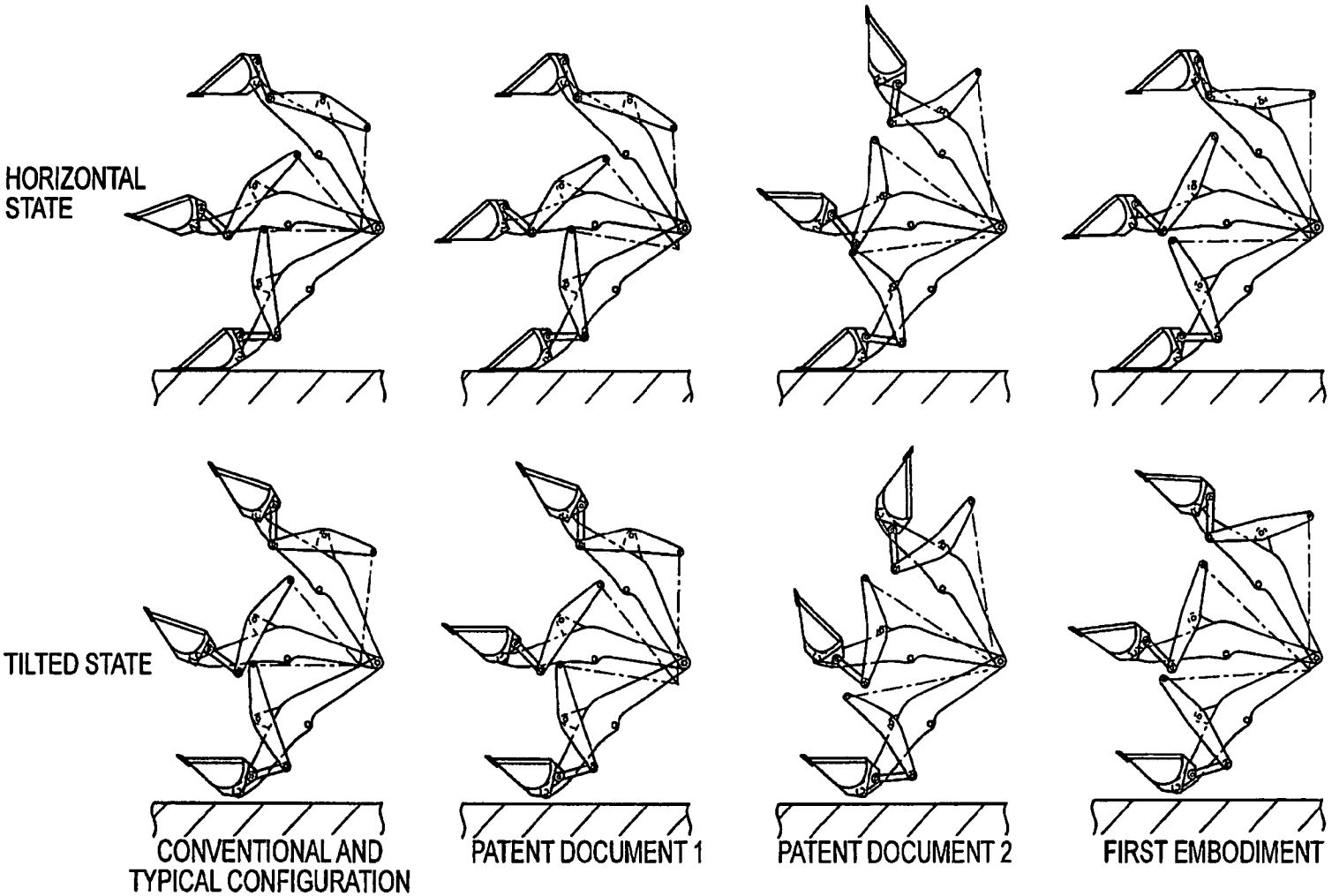
FIG. 9 is still another view for illustrating an effect of the first embodiment.

Namely, with the inclined angle of 10 degrees, displacement amount toward the minus side at the middle position of the bucket 20 and displacement amount toward the plus side at the top position thereof are equal (in the present embodiment, approximately ±6 degrees), and the absolute values of the attachment angles for the horizontal posture are equal to each other, so that the bucket is not largely displaced toward the dumping direction or the vehicle body 16 side, which is preferable for the scooping mud or the like having fluidity (see the most right section of FIG. 9).

With the inclined angle of 10 degrees or more, the displacement from the middle position to the top position becomes gradually smaller and the displacement toward the tilting direction at the top position is also reduced, so that the mud or the like is more hardly spilt at least on the vehicle side (the operator side) relative to the position at which the displacements are equal, which is suitable for the scooping work or the like.

With the inclined angle of 35 degrees, the attachment angle is 0 degree at the top position, but when the angle is over 35 degrees, the attachment angle is displaced toward the damping direction, therefore the inclined angle of 35 degrees or less is desirable for performing work in which the displacement toward the dumping direction at the top position is not allowable.

Further, with the inclined angle of over 35 degrees, although the attachment angle is displaced toward the damping direction both at the intermediate position and the top position, the displacement amount between the intermediate position and the top position becomes small, so that the angle of 35 degrees or more may be employed for performing the scooping work or the like while reducing the displace amount.

Figure 7:
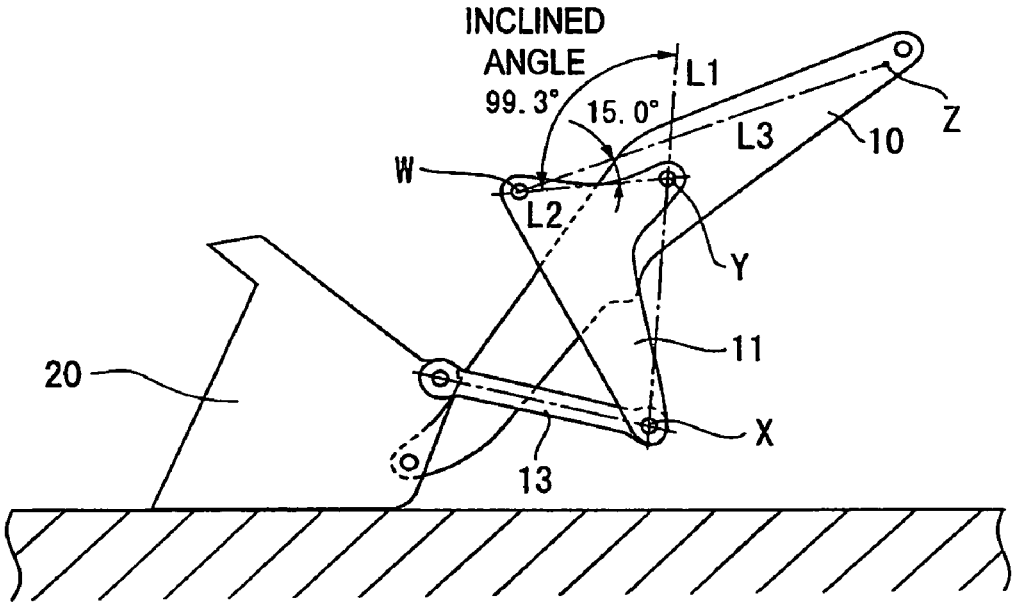
FIG. 7 is a view for illustrating a maximum tilt angle of a bell crank of the first embodiment.
Figure 8:
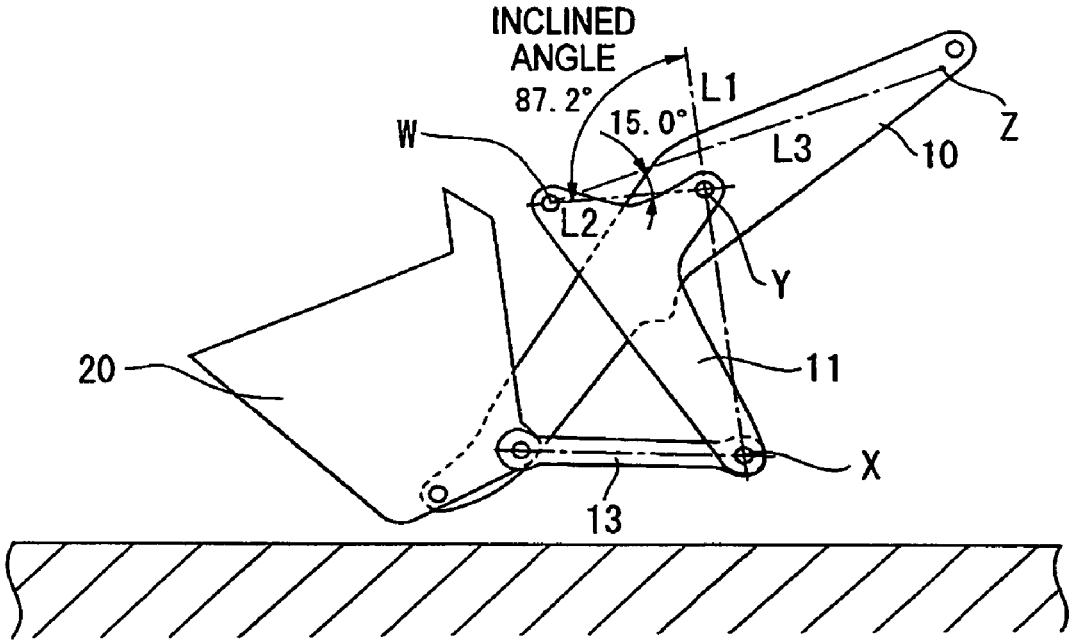
FIG. 8 is another view for illustrating the maximum tilt angle of the bell crank of the first embodiment.

Further, a maximum inclined angle varies depending on setting of each pivot position X, Y, Z, the length of the bell crank 11 or the like. On the other hand, as shown in FIGS. 7 and 8, it is preferable to set an angle formed by a line L3 connecting pivot positions W, Z and a line L2 connecting the pivot positions W, Y when seen from the side in the range where about 15 degrees or more is assured. When the angle formed by the lines L2, L3 is less than 15 degrees, as the lines L2 and L3 become close to each other into the overlapping direction when seen from the side, the tilt cylinder 12 may become unfunctional where the bucket 20 may not be kept horizontal on the ground or the tilted posture of the bucket 20 may not be recovered.

The maximum inclined angle capable of keeping the bucket 20 horizontal is, for instance, approximately 99 (99.3) degrees in the case as shown in FIG. 7. The maximum inclined angle capable of recovering the tilted posture of the bucket 20 is, for instance, approximately 87 (87.2) degrees in the case as shown in FIG. 8 with the tilted angle of 42 degrees relative to the ground.

It is desirable that the inclined angle is set in the range where the angle characteristics and the tilting force characteristics can be properly kept with some surplus, i.e. the inclined angle is approximately 80 (79.5) degrees in the embodiment.

According to the present invention, the effects described below can be obtained.

Figure 35:
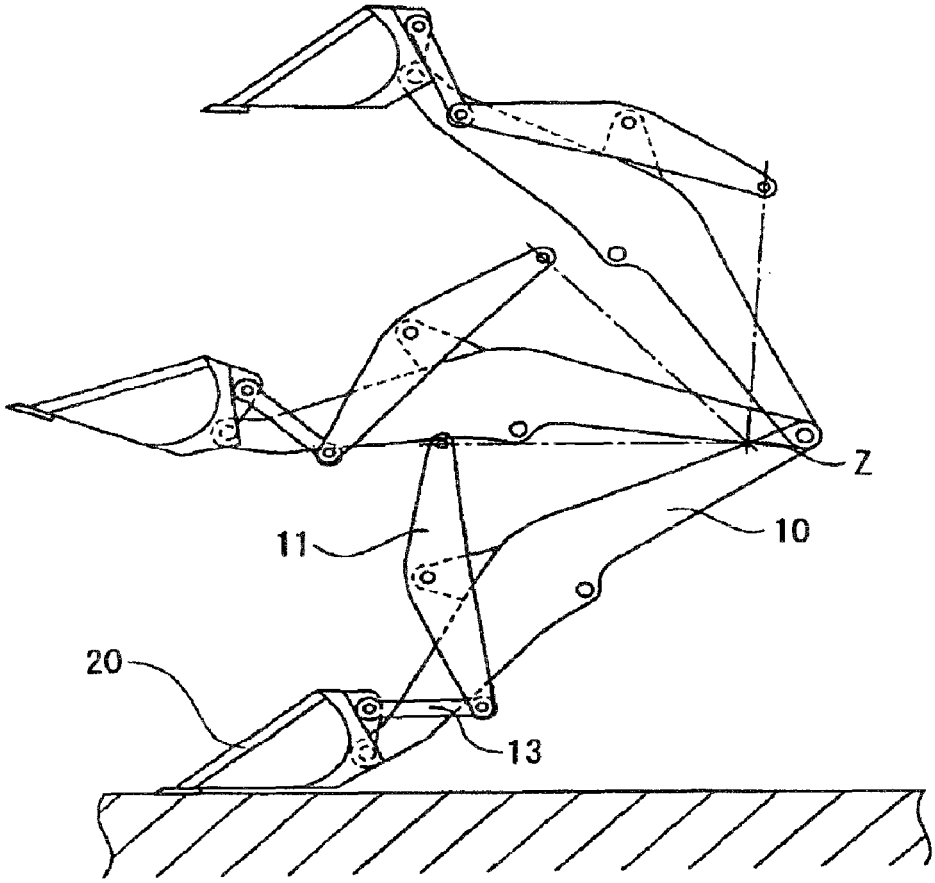
FIG. 35 Prior Art
FIG. 35 is a view for illustrating movements of a typical Z-bar link in the conventional technology.
Figure 36:
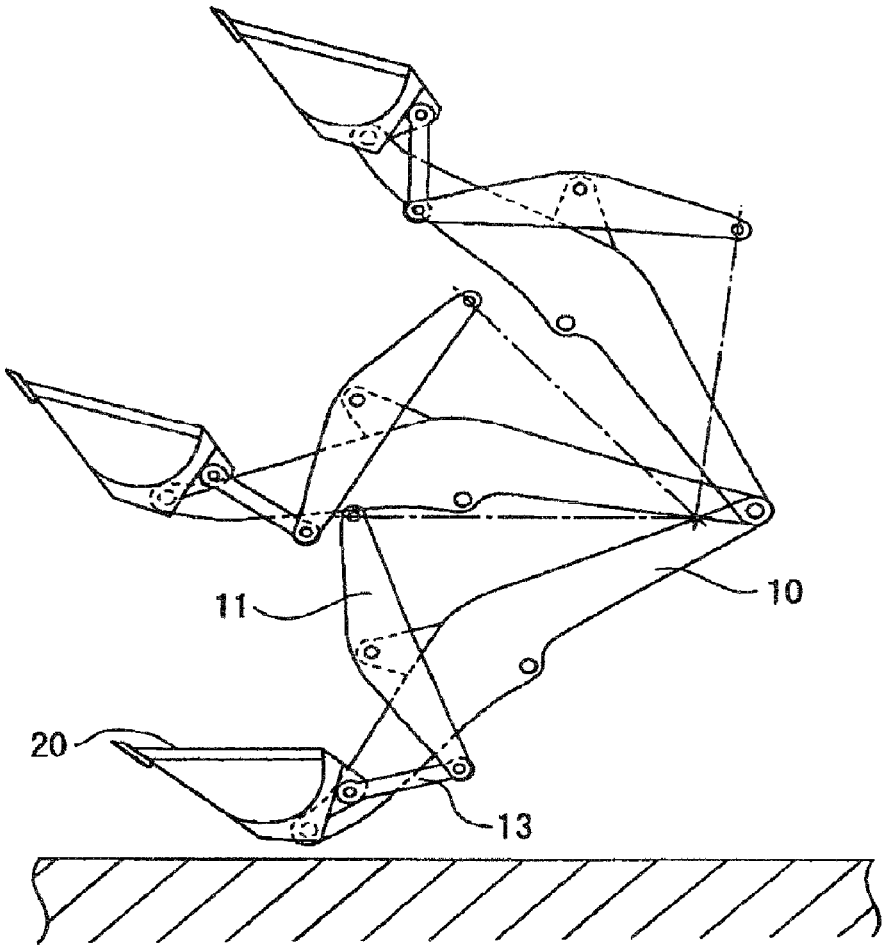
FIG. 36 Prior Art
FIG. 36 is another view for illustrating the movements of the typical Z-bar link in the conventional technology.
Figure 37:
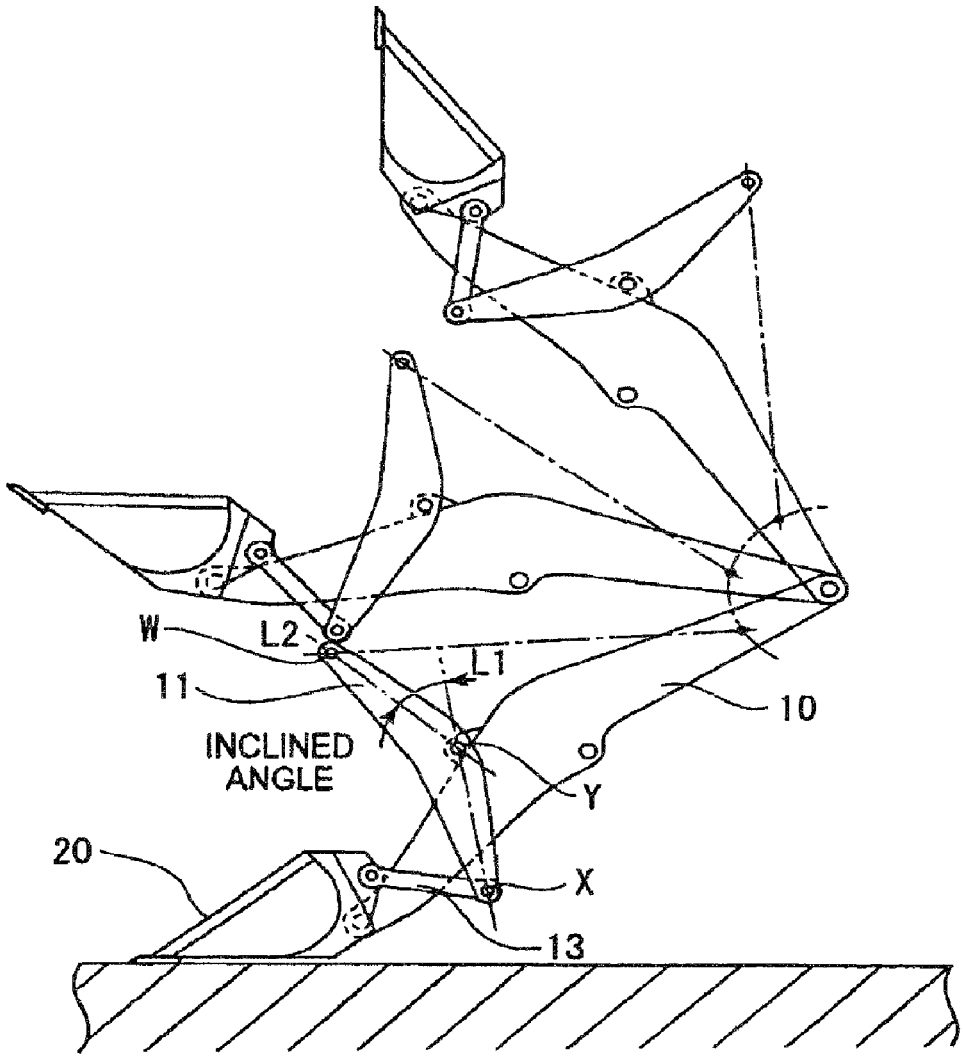
FIG. 37 Prior Art
FIG. 37 is a view for illustrating movements of another working machine in the conventional technology.
Figure 38:
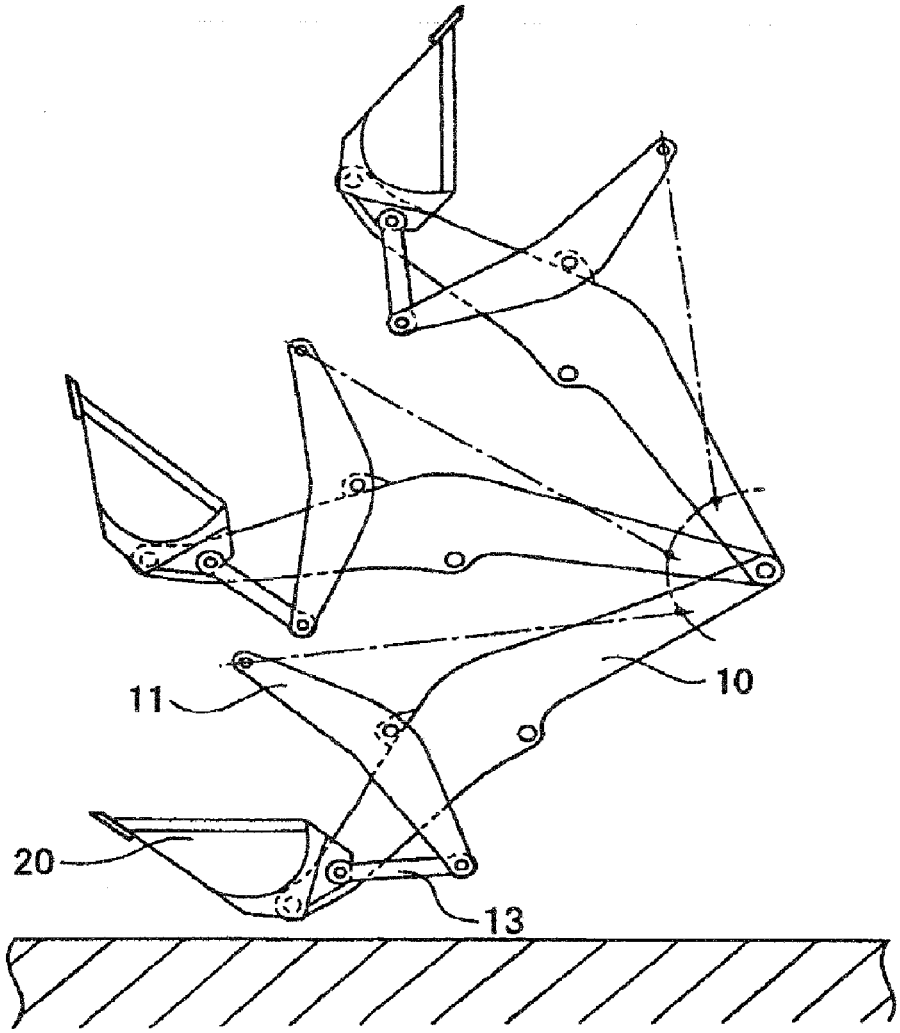
FIG. 38 Prior Art
FIG. 38 is another view for illustrating the movements of the other working machine.

(1) In the wheel loader 1, the base end of the tilt cylinder 12 is not attached to the boom 10 but is pivoted on the structural body 16A, and in the bell crank 11, the line segment L2 is inclined toward the bucket 20 side relative to the line segment L1 and the angle between the line segment L1 and the line segment L2 is set in the range from 0 degree to 180 degrees, therefore the displacement of the attachment angle of the bucket 20 can be reduced from the ground position to the top position in both cases of attaching the bucket 20 at the ground position without tilting or by tilting, and the angle characteristics can be considerably increased compared with that in the configuration using the conventional Z-bar link (FIG. 35, FIG. 36) or the configurations disclosed in Patent documents 1, 2 (FIG. 37, FIG. 38), so that not only the conventional digging work but also the scooping work of mud or the like can be appropriately performed.

Specific comparison is shown in FIG. 9. It is to be noted that in FIG. 9, reference numerals to each component are omitted. From the figure, it is understood that, in the cases where the bucket 20 is positioned horizontally on the ground and where the bucket 20 is tilted on the ground, the angle characteristics from the structural ground position to the top position of the configuration of the embodiment is the most excellent compared with that in the typical configuration based on the conventional technology or the configurations according to Patent documents 1, 2.

Namely, in the typical configuration based on the conventional technology, the angle characteristics when using the bucket 20 not tilted is not so bad, however, the attachment angle at the top position when the bucket 20 is tilted on the ground is largely displaced toward the tilting direction, which is disadvantageous.

In Patent document 1, the angle characteristics when the bucket 20 is not tilted on the ground is excellent, however, the attachment angle when the bucket 20 is tilted is largely displaced especially at the top position, which is also disadvantageous. In Patent document 2, since the pivot position Z is disposed on the boom 10, the angle characteristics is bad regardless that the bucket 20 is tilted or not.

Meanwhile, in the embodiment, the tilt cylinder 12 is pivoted on the structural body 16A; the pivot position Z is disposed below the pivot position S of the boom 10 on the structural body 16A; and the second line segment L2 of the bell crank is inclined toward the attachment 20 side relative to the first line segment L1, so that when the bucket 20 is not tilted, the excellent angle characteristics can be obtained like in Patent document 1, and even when the bucket 20 is tilted, only a little displacement occurs at the intermediate position and at the top position, and the bucket 20 can be lifted up to the top position, while keeping substantially same tilted posture, which shows the excellent angle characteristics.

(2) When the bucket 20 is tilted and used at the ground position, since the inclined angle of the bell crank 11 toward the bucket 20 side is set to a value such that, for instance, the displacement amount toward the dumping direction of the bucket 20 at the intermediate position and the displacement toward the tilting direction of the bucket 20 at the top position are equal, and large displacement toward the dumping direction or toward the tilting direction does not occur, so that the scooping work can be performed more appropriately. Further, when the inclined angle is set larger than that described above, the displacement between any two positions (for instance, the intermediate position and the top position) becomes gradually smaller and the displacement toward the tilting direction is also reduced, so that the mud or the like is more hardly spilt at least on the vehicle body 16 side (i.e. the operator side) relative to the position at which the displacements are equivalent, thereby the scooping work or the like can be adequately performed.

Second Embodiment

Figure 10:
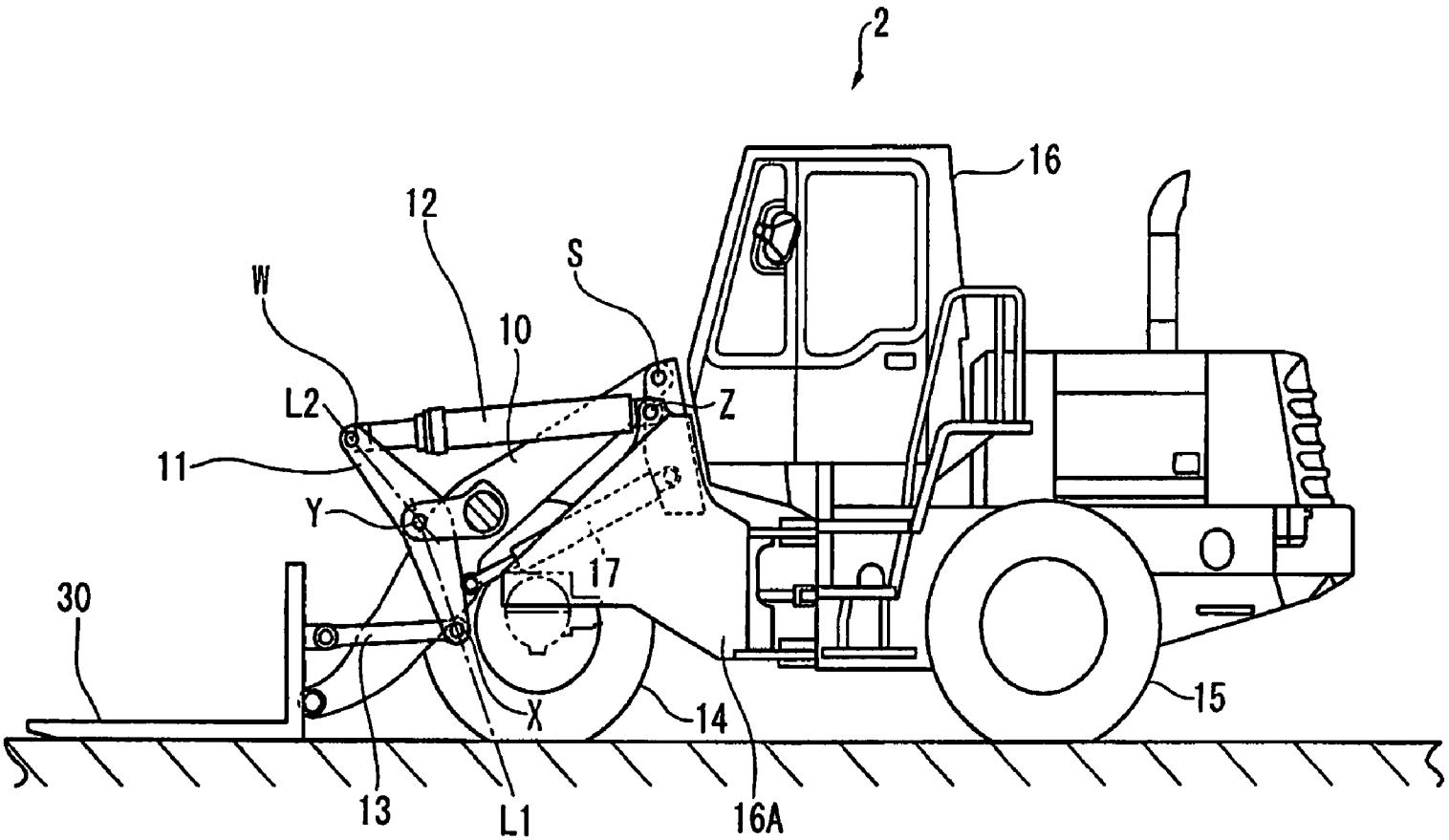
FIG. 10 is a side view showing a working machine according to a second embodiment of the present invention.

FIG. 10 shows, as a second embodiment of the present invention, a wheel loader 2 with a fork 30 (a fork or the like) attached thereto in replacement of the bucket 20 of the first embodiment. Other configurations are substantially same as those of the first embodiment.

In the wheel loader 2, the fork 30 is attached to the substantially same position as the position of the bucket 20 of the first embodiment, and therefore displacement of an attachment angle of the fork 30 horizontally attached at the ground position does not occur up to the top position like the bucket 20 of the first embodiment, where excellent angle characteristics is kept.

Further, in the wheel loader 2, since the line segment L2 is inclined toward the fork 30 side relative to the line segment L1 of the bell crank 11, the tilting force at the top position becomes larger compared with the case of the wheel loader disclosed in Patent document 3, and thereby the tilting force characteristics is also improved.

Figure 11:
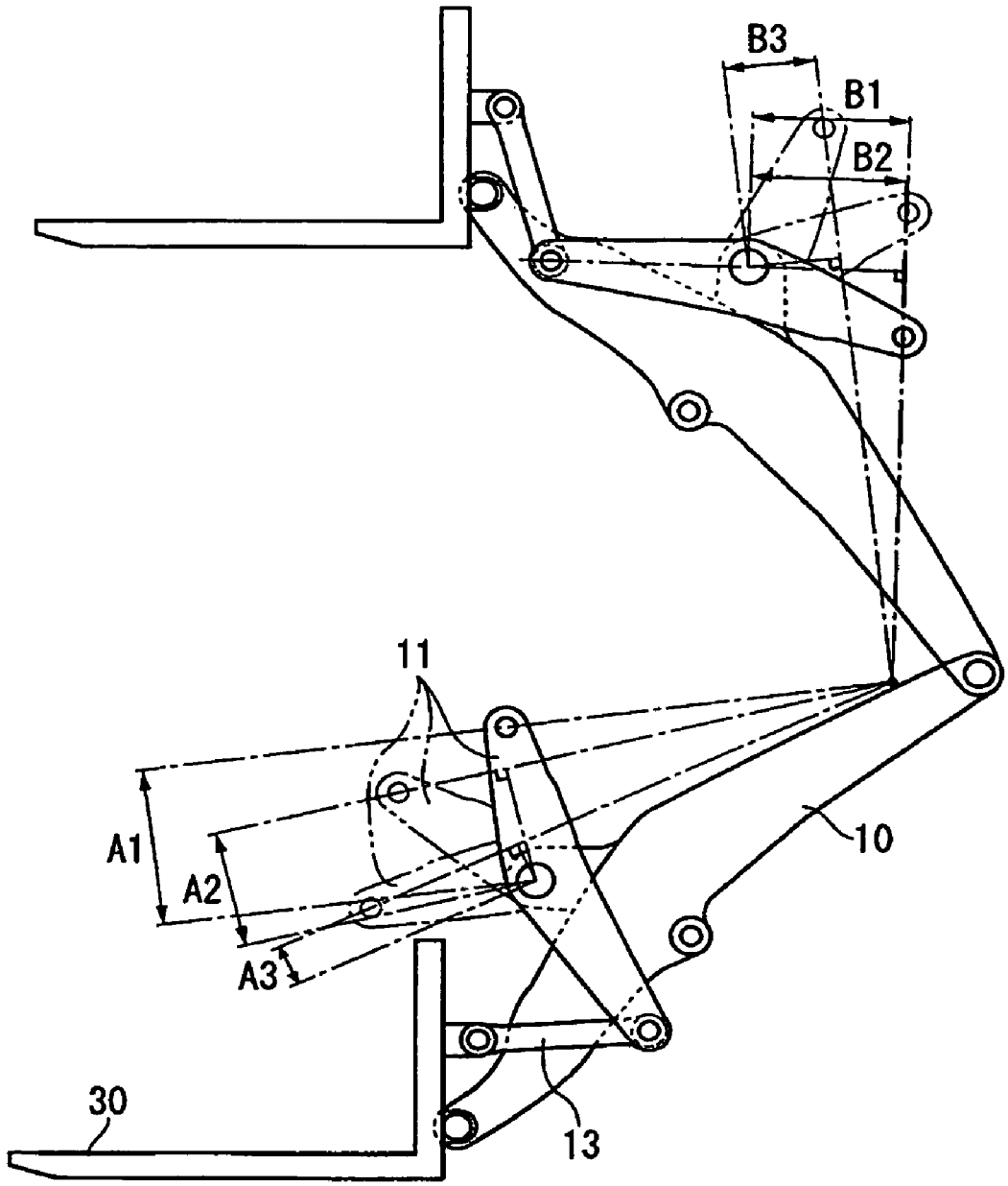
FIG. 11 is a view for illustrating a mechanism of the second embodiment.

The improvement of the tilting force will be described below with reference to FIGS. 11 and 12. FIG. 11 shows a state where the angle between the line segment L1 and the line segment L2 of the bell crank 11 is tilted toward the fork 30 side from the conventional angle (Patent document 3 is assumed) by 45 and 90 degrees (refer to the chain double-dashed lines). A1, A2, and A3 herein indicate an effective length at the upper portion of the bell crank 11 at the ground position at the conventional angle, 45 degrees, and 90 degrees respectively, and B1, B2, B3 indicate each effective length at the top position respectively.

Figure 12:
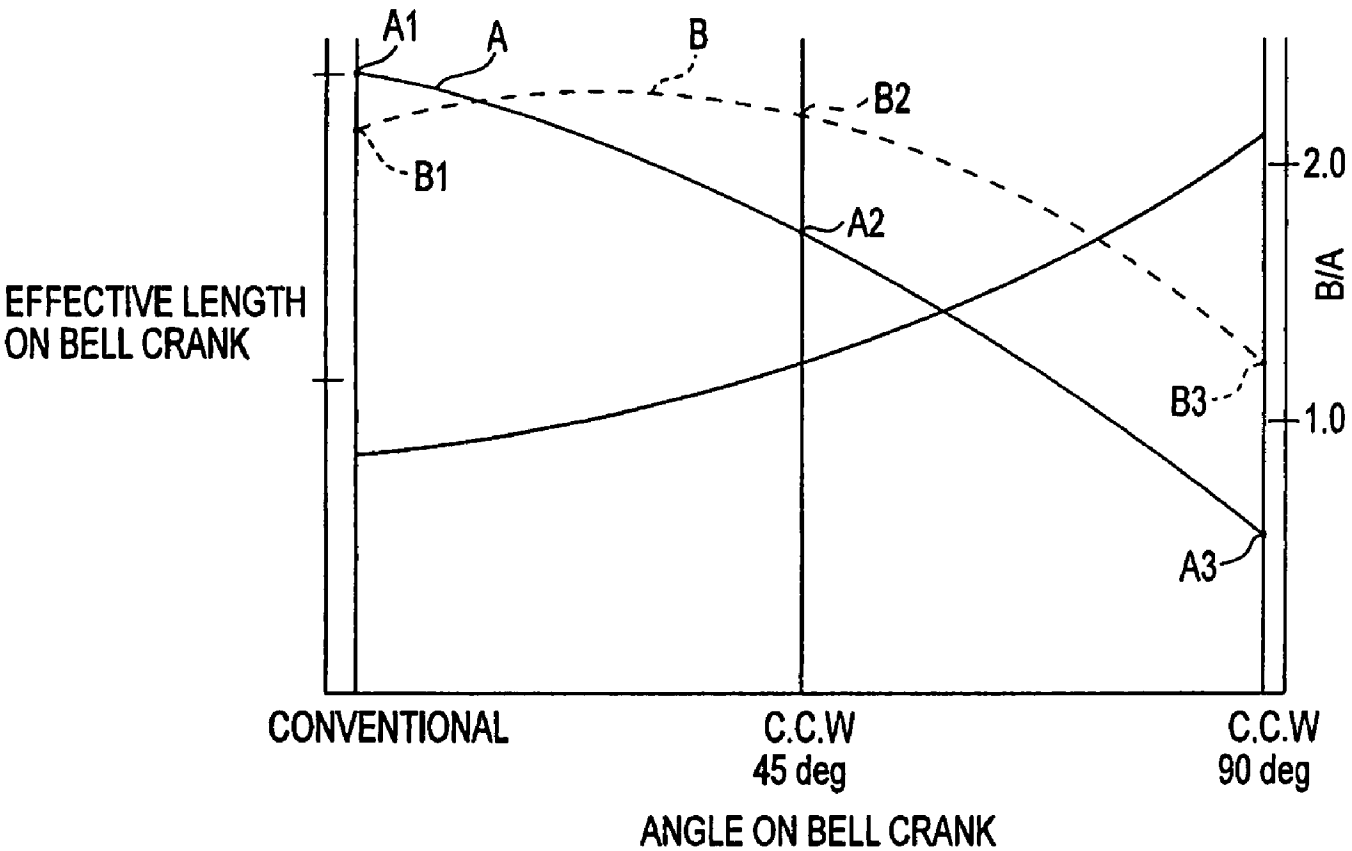
FIG. 12 is a graph for illustrating the mechanism of the second embodiment.

FIG. 12 shows the relation between an angle between the line segment L1 and the line segment L2 of the bell crank 11 (horizontal axis) and effective lengths A, B (left vertical axis), and the relation between the angle between the line segment L1 and the line segment L2 of the bell crank 11 (horizontal axis) and a ratio of the effective lengths B/A (right vertical axis).

The ratio of the effective lengths B/A herein indicates (rotating force of the bell crank 11 at the top position/rotating force of the bell crank 11 at the ground position), where the larger a value is, the larger the tilting force at the top position is.

Therefore, according to FIGS. 11 and 12, the more the line segment L2 is tilted toward the fork 30 relative to the line segment L1 of the bell crank 11, the more the effective lengths A and B become short, but the ratio of the effective lengths B/A increases due to large reduction of the effective length A, thus the tilting force at the top position increases, improving the tilting force characteristics.

According to this embodiment, the following effects described above can be obtained.

(3) In the wheel loader 2, since the line segment L2 is tilted toward the fork 30 side relative to the line segment L1 of the bell crank 11, namely the angle between the line segment L1 and the line segment L2 is set in the range from 0 to 180 degrees on the fork side, the ratio of the effective lengths B/A at the upper portion of the bell crank 11 (tilted side) at the ground position and at the top position can be increased. Therefore, in the technology described in Patent document 3 in which the bucket 20 is replaced with the fork 30 and the bell crank 11 of which the second line segment L2 is tilted toward the vehicle body 16 side is used, lifting/unloading work of cargos using the fork 30 is difficult, but in this embodiment, because the tilting force characteristics is improved by increasing the tilting force especially at the top position, tilting force characteristics suitable for use of the fork can be obtained and the lifting/unloading work of cargos can be easily and properly performed.

(4) In addition, since the pivot position Z of the base end side of the tilt cylinder 12 is disposed not on the boom 10 but on the structural body 16A, the pivot position Z can be set to a position at which displacement of the attachment angle of the fork 30 can be more reduced, and the angle characteristics is also improved to provide the angle characteristics suitable for the fork 30.

Third Embodiment

Figure 13:
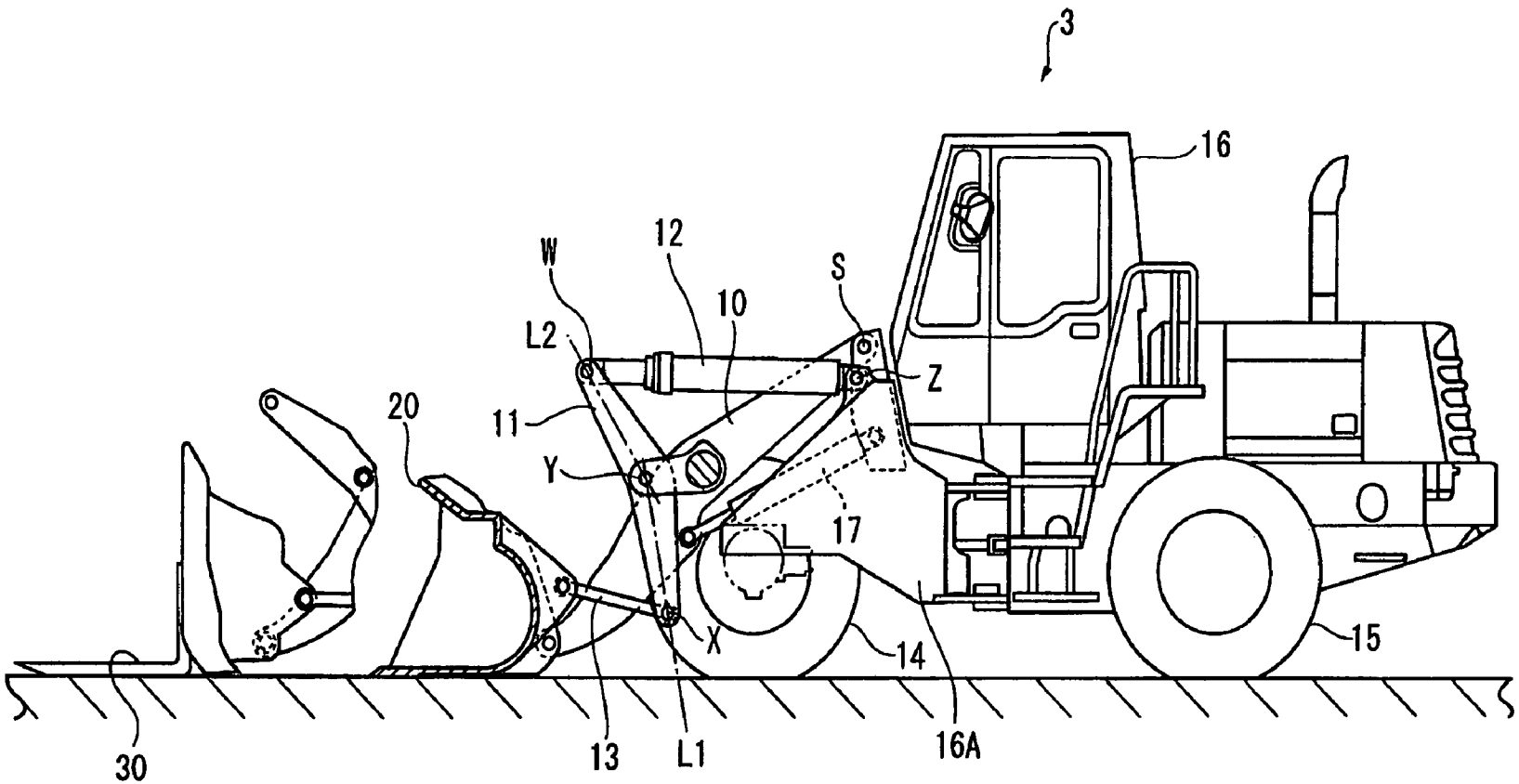
FIG. 13 is a side view showing a working machine according to a third embodiment of the present invention.
Figure 14:
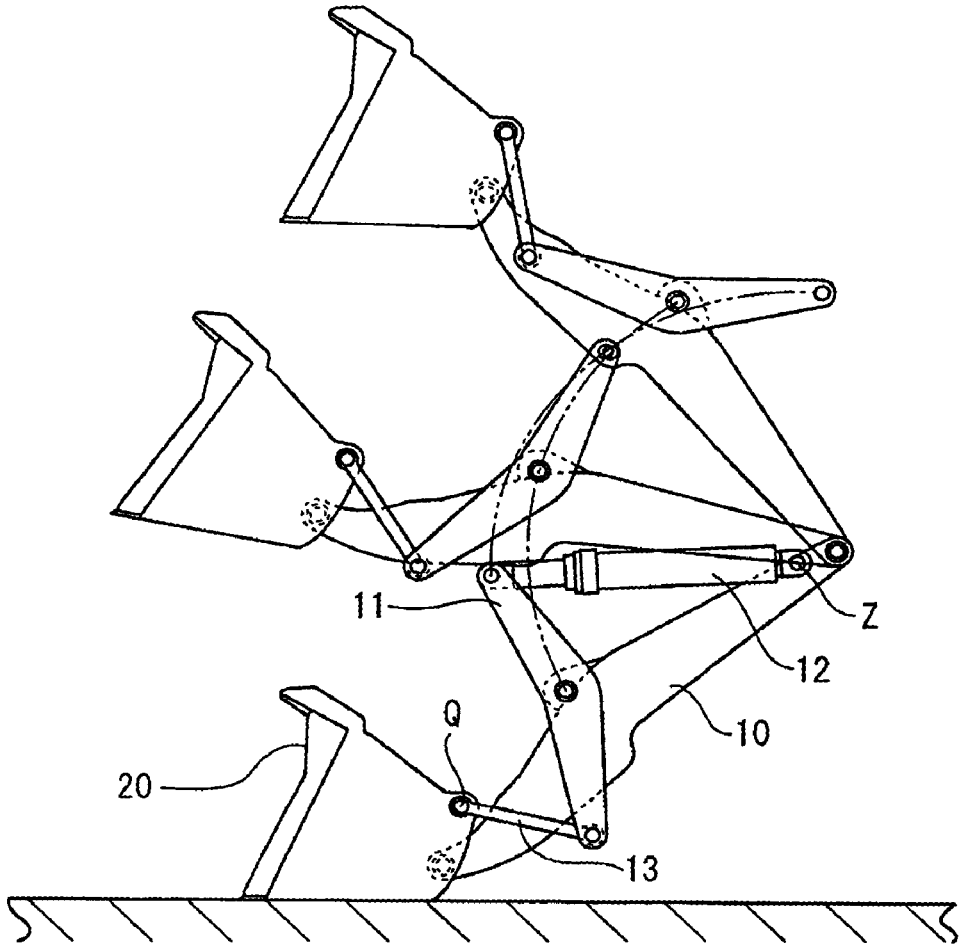
FIG. 14 is a view for illustrating movements of the working machine according to the third embodiment of the present invention.
Figure 15:
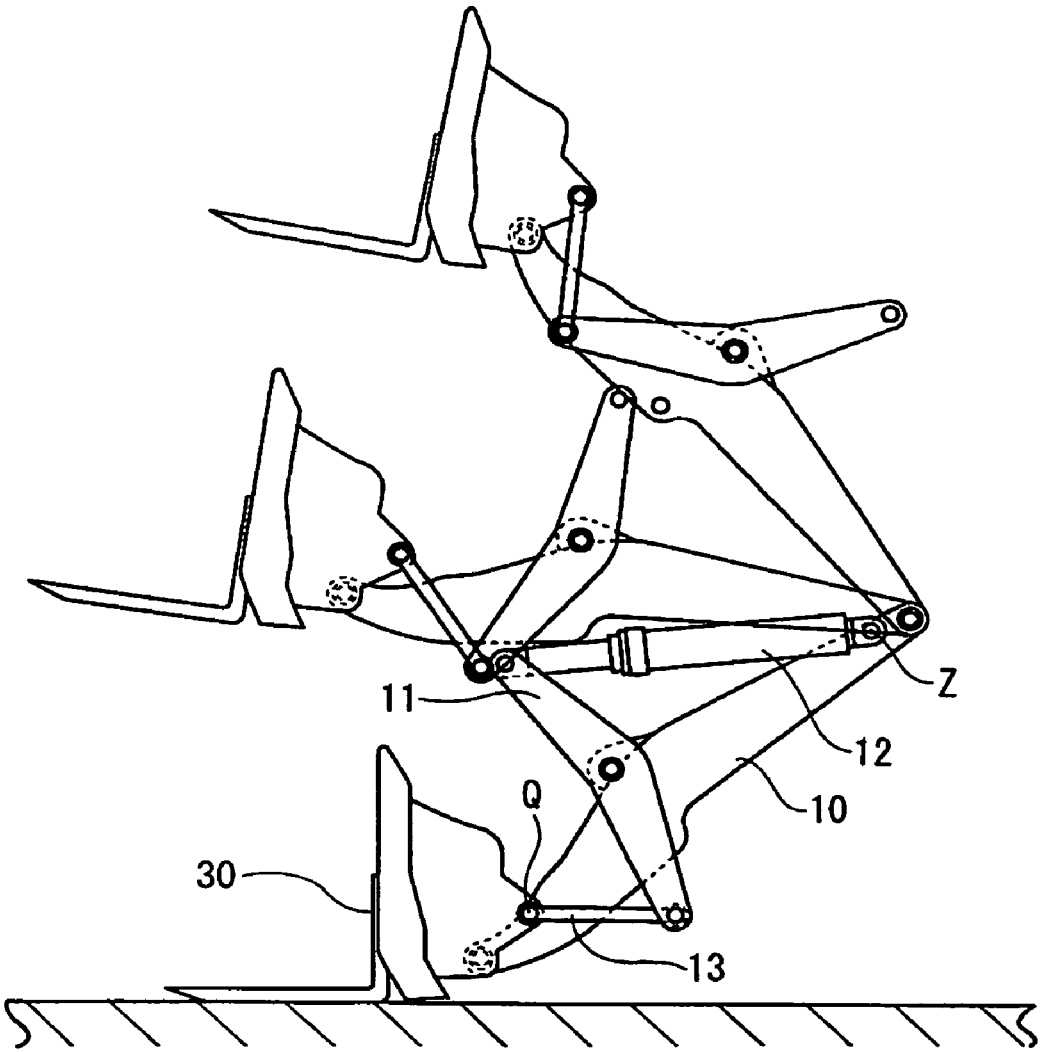
FIG. 15 is a view for illustrating the movements in an alternative way of the third embodiment.

FIG. 13 shows a wheel loader 3 according to a third embodiment of the present invention. FIG. 14 is a view in which a bucket (attachment) 20 of two prepared attachments is used, and FIG. 15 is a view in which a fork (attachment) 30 is used. Either the bucket 20 or the fork 30 may be attached for dedicated work, or may be selectively used depending on the work.

Figure 16:
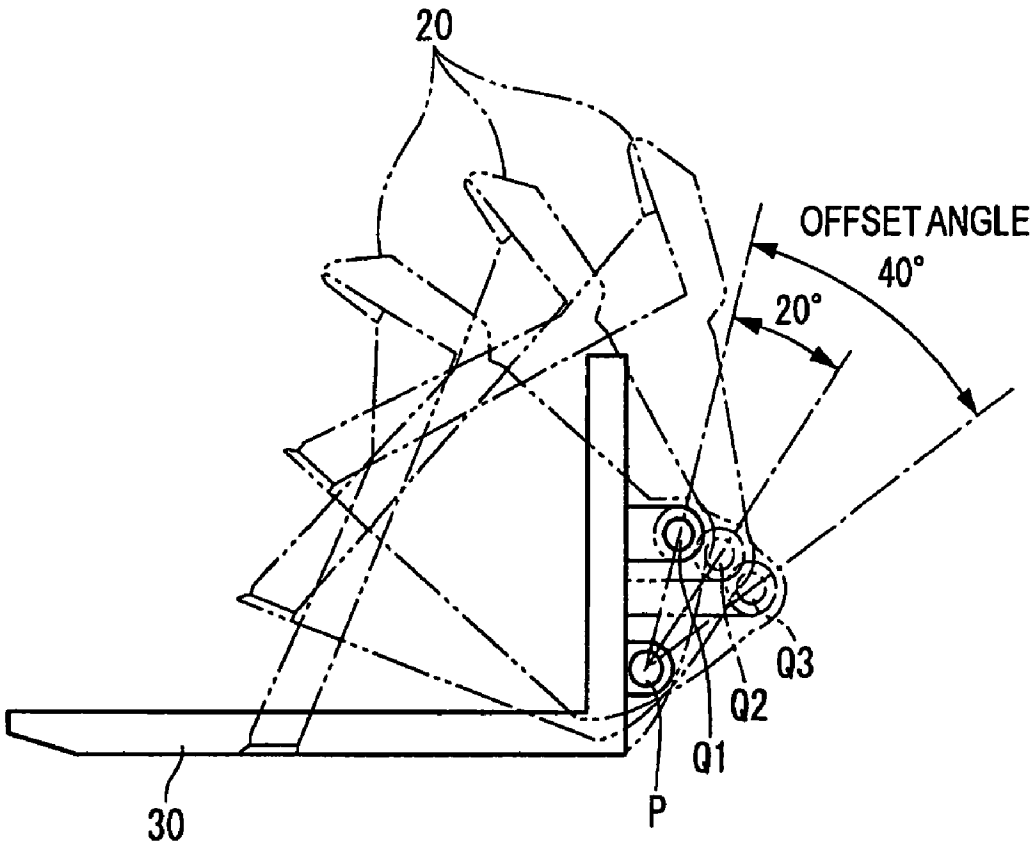
FIG. 16 is an enlarged view showing a primary portion of the third embodiment.

In this embodiment, as shown in FIGS. 14, 15 and 16, a pivot position Q of the bucket 20 on the connecting link 13 and a pivot position Q of the fork 30 on the connecting link 13 are set at different positions in relation to the pivot position P on the boom 10. The pivot position Q of the fork 30 is set at an offset position where the tilt cylinder 12 is somewhat advanced compared with the case of the bucket 20. Thus, the tilting force when using the fork 30 is further improved than the second embodiment.

This feature will be described with reference to FIGS. 16, 17 and 18. FIG. 16 shows states where the pivot position Q of the fork 30 of the connecting link 13 is offset by 20 degrees or 40 degrees compared with the case of the bucket 20 (Q1, Q2, Q3). However, since the offset angles are equivalent to the positions of the bucket 20 tilted by 20 degrees and 40 degrees, FIG. 16 also shows the tilted state of the bucket 20 in chain double-dashed lines.

Figure 17:
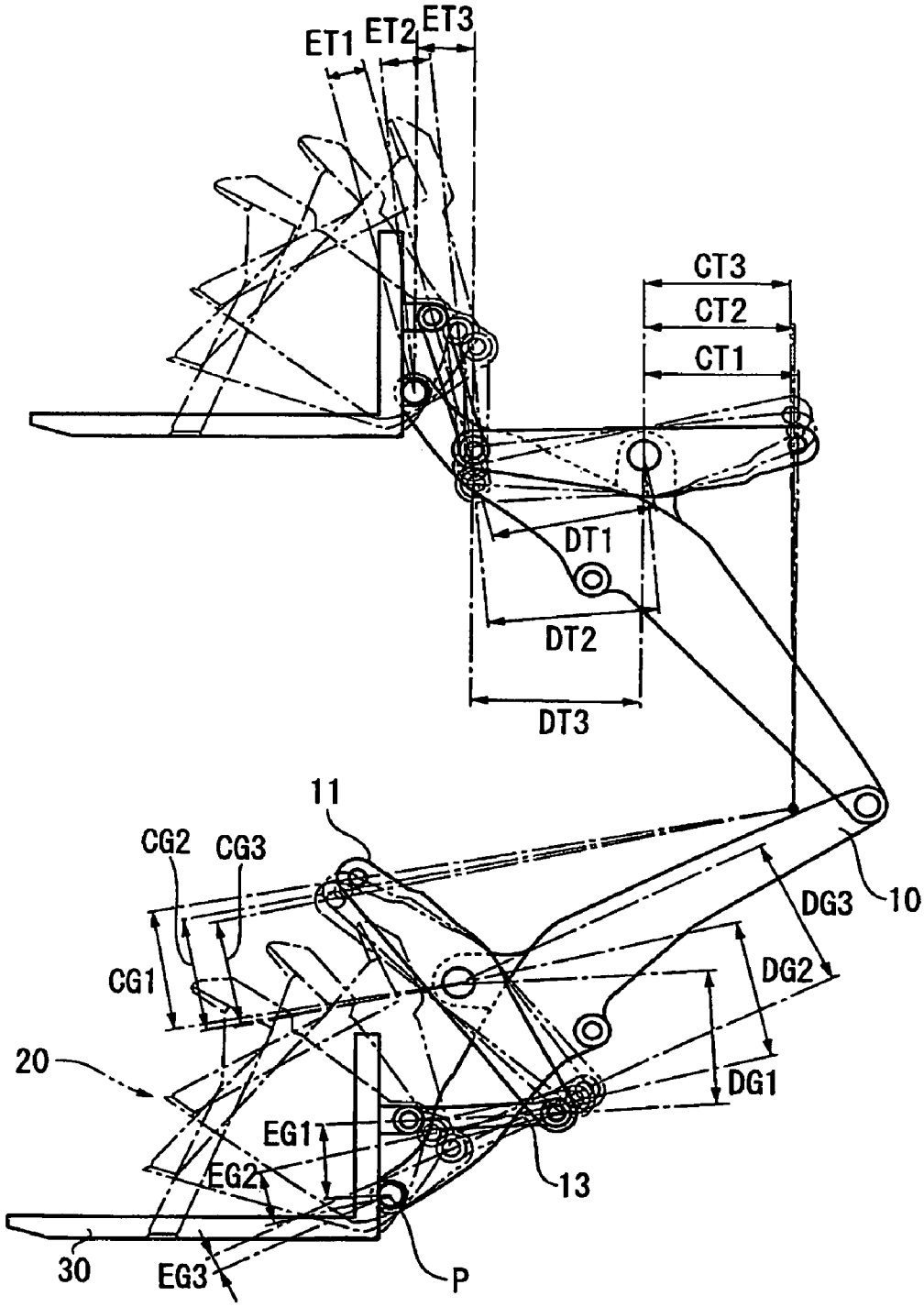
FIG. 17 is a view for illustrating a mechanism of the third embodiment.

In FIG. 17, CG1 to CG3, DG1 to DG3, and EG1 to EG3 respectively indicate effective lengths of the upper portion of the bell crank 11, effective lengths of the lower portion of the bell crank 11, and effective lengths of the distance from the pivot position P on the boom 10 to the pivot positions Q1 to Q3 (FIG. 16) for the pivot positions Q1 to Q3 at the ground position. Also, CT1 to CT3, DT1 to DT3, and ET1 to ET3 indicate such effective lengths at the top position respectively.

Figure 18:
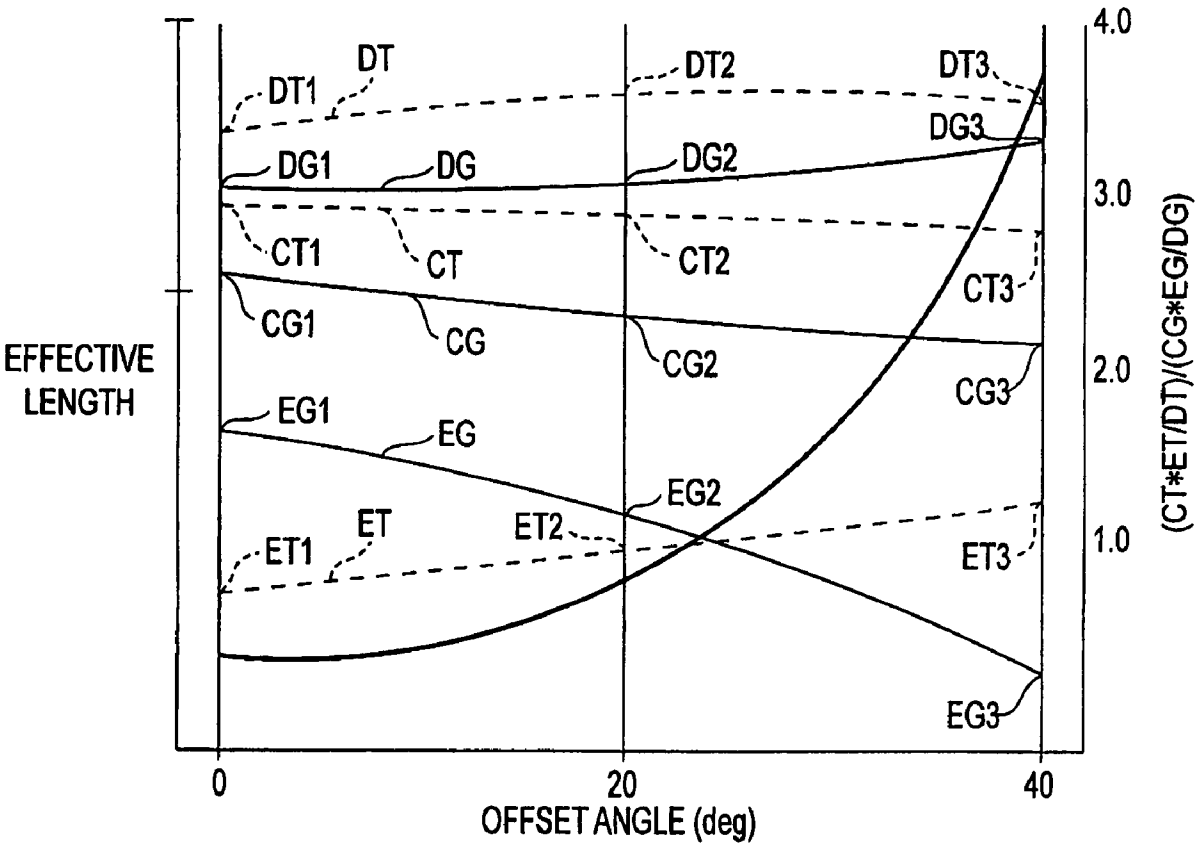
FIG. 18 is a graph for illustrating the mechanism of the third embodiment.

FIG. 18 shows the relations between the offset angle (horizontal axis) and the effective lengths CG, DG, EG, CT, DT, and ET (left vertical axis), and the relations between the offset angle (horizontal axis) and ratios of the tilting forces (CT*ET/DT)/(CG*EG/DG) (right vertical axis). Here, the ratio of the effective lengths (CT*ET/DT)/(CG*EG/DG) indicates (tilting force at the top position/tilting force at the ground position), where the larger the value is, the larger the tilting force at the top position becomes, thereby improving the tilting force characteristics.

According to FIGS. 17 and 18, even if the offset angle is increased, the effective lengths CG, DG, CT, and DT do not significantly change, but the effective length EG obviously decreases and the effective length ET increases. Thus, the ratio of the effective lengths (CT*ET/DT)/(CG*EG/DG) increases as the offset angle is set to a larger value, and the tilting force at the top position also increases, improving the tilting force characteristics.

Figure 5:
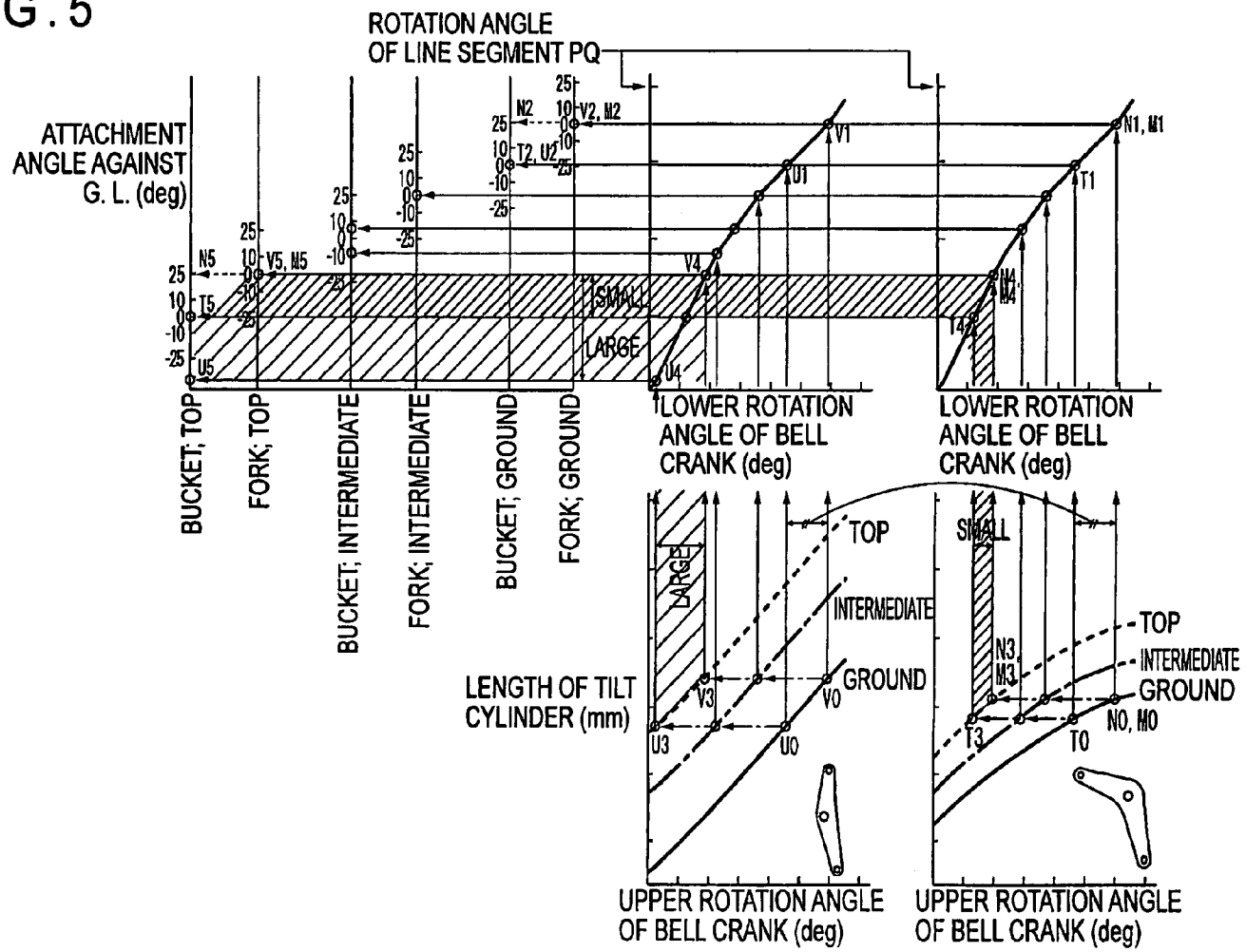
FIG. 5 is a graph showing angle characteristics of a conventional working machine and the working machine of the present invention.

On the other hand, basically, the angle characteristics in a case of attaching the bucket 20 is substantially the same as the angle characteristics in the first embodiment, namely the characteristics shown by the points T0 to T5 in FIG. 5. Also, since attaching the fork 30 at the offset position is equivalent to tilting the bucket 20 on the ground in the first embodiment, the angle characteristics thereof is basically indicated by the points M0 to M5 plotted on the points N0 to N5 in FIG. 5. As a result, in both cases of using the bucket 20 and the fork 30, the difference in each angle characteristics from the ground position to the top position decreases, improving the angle characteristics.

According to this embodiment, the following effects described above can be obtained.

(5) In the wheel loader 3, in a case where the fork 30 is attached in replacement of the bucket 20, since the bell crank 11 is offset by being rotated and moved in the tilting direction and the fork 30 is attached in this state, the tilting force at the top position can be significantly improved compared with the case where the bucket 20 is attached without being offset, so that more suitable tilting force characteristics for the fork 30 can be obtained. Further, as described in the second embodiment, improvement of the tilting force can be obtained by tilting the second line segment L2 on the bell crank 11 toward the fork 30 side.

Hence, by attaching the fork 30 at the offset position, even greater tilting force can be obtained at the top position compared with the technology in the patent document 3 in which the bucket 20 is used in replacement of the fork 30.

Figure 19:
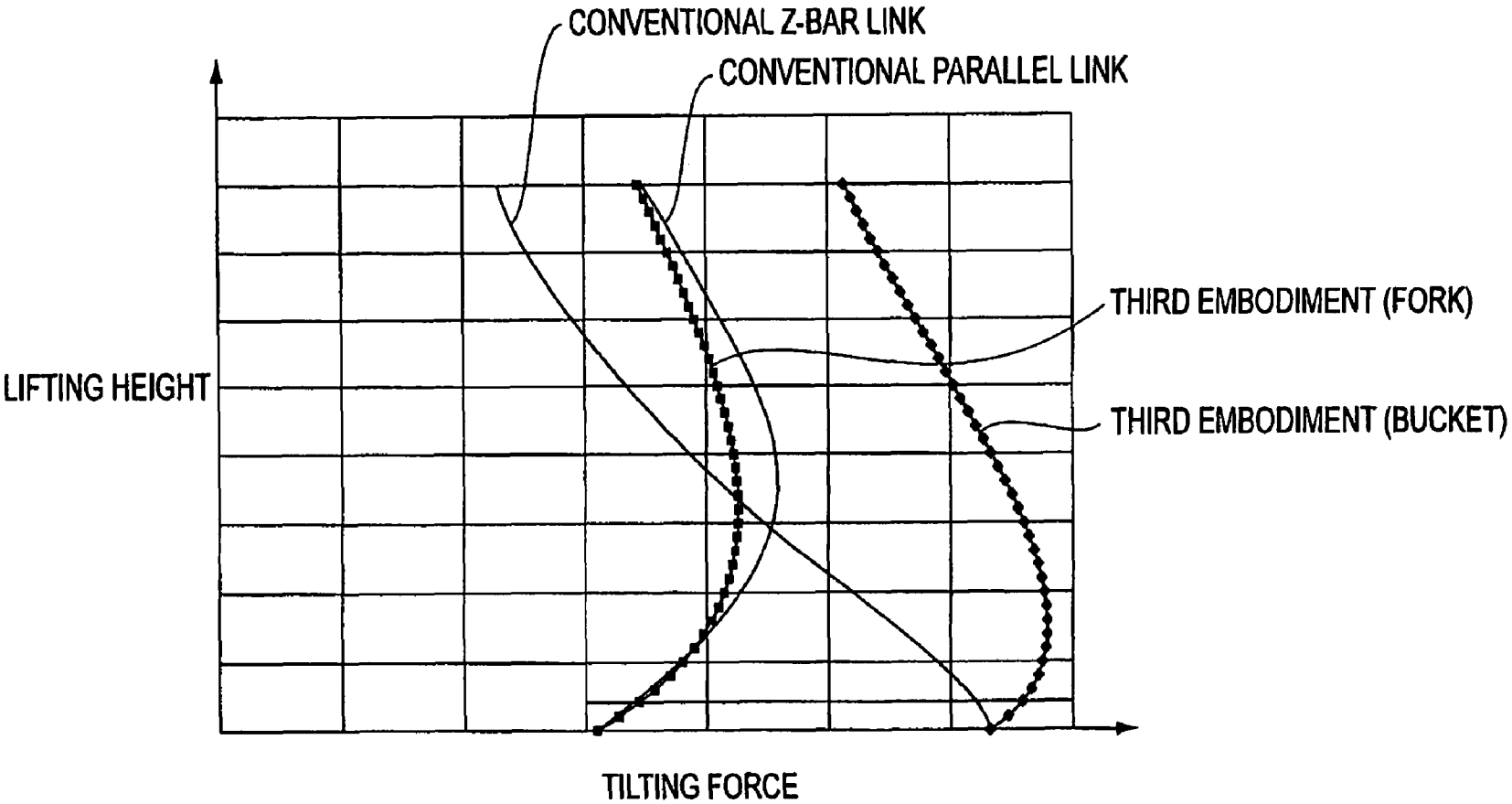
FIG. 19 is another graph for illustrating an effect of tilting force characteristics of the third embodiment.

Furthermore, as shown in FIG. 19, the tilting force characteristics is not inferior to the case of the conventional parallel link which is generally used for the fork 30, so that lifting/unloading work of cargos or the like can be properly performed like the wheel loader equipped with the conventional parallel link.

(6) In a case where the bucket 20 is attached, since the tilting force characteristics is improved because the line segment L2 is tilted toward the bucket 20 side relative to the line segment L1 of the bell crank 11 and the angle between the line segment L1 and the line segment L2 is set in the range from 0 to 180 degrees on the bucket 20 side, and when compared with the conventional configuration using the conventional Z-bar link and the bucket 20 (FIGS. 35, 36), while keeping the tilting force characteristics at the ground position, the tilting force characteristics at an even higher position can be significantly improved as shown in FIG. 19, where digging work using the bucket 20 at a higher position than usual can be smoothly performed.

Figure 20:
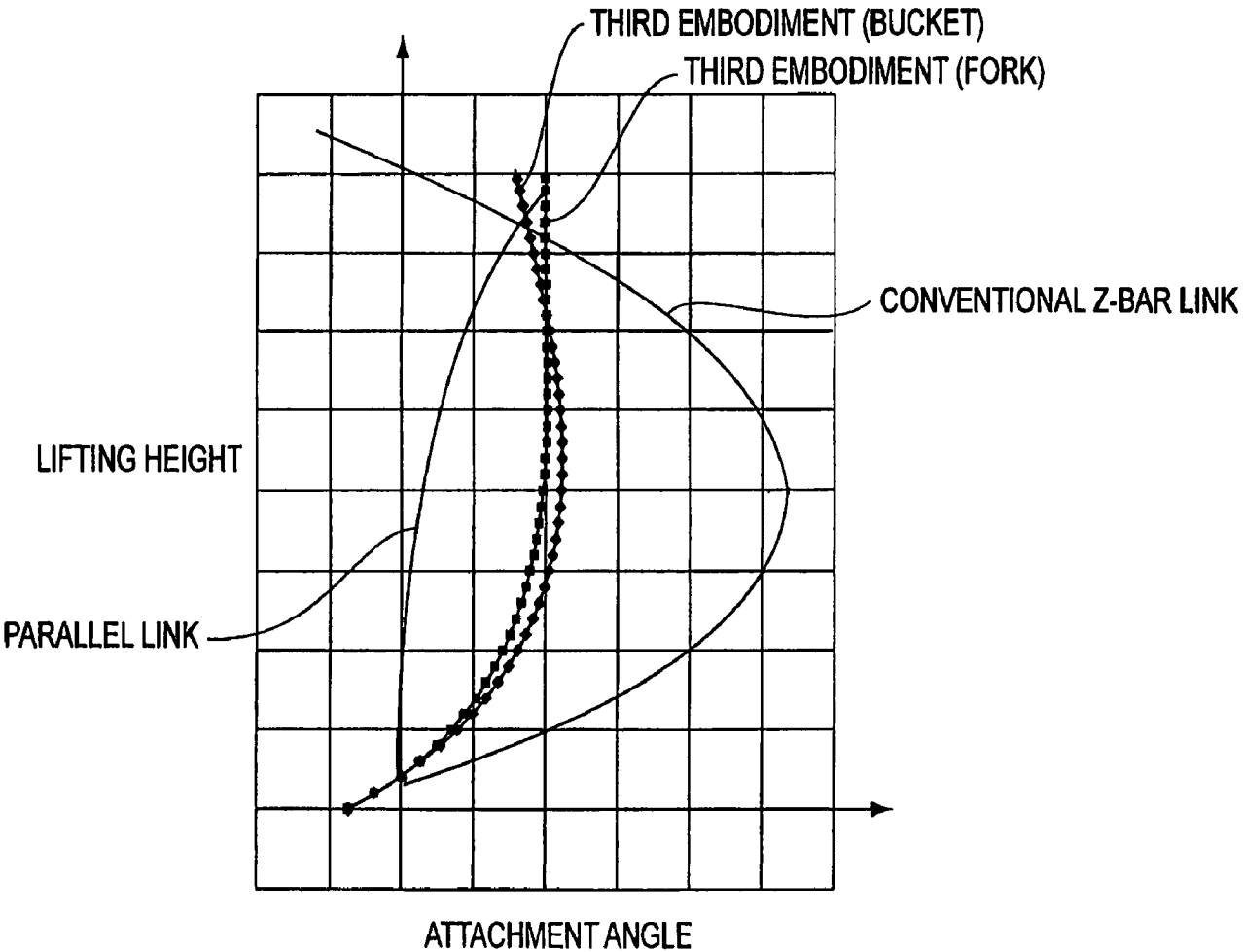
FIG. 20 is still another graph showing angle characteristics of the third embodiment.

(7) Furthermore, when the bucket 20 is used in the configuration same as the first embodiment (i.e. the configuration in which the tilt cylinder 12 is pivoted on the structural body 16A of the vehicle body 16, the pivot position Z is disposed below the pivot position S of the boom 10 on the structural body 16A, and the second line segment L2 of the bell crank is tilted toward the attachment 20 side relative to the first line segment L1), the angle characteristics is excellent and the angle characteristics can be considerably improved as shown in FIG. 20 compared with the case of the conventionally typical Z-bar link.

On the other hand, also when the fork 30 is used, since the second line segment L2 on the bell crank 11 is tilted toward the fork 30 side, attaching the fork 30 at the offset position at the ground position is, as described in the first embodiment, equivalent to attaching the bucket 20 in the tilted posture, and differences between each angle characteristics can be reduced as shown in FIG. 20 compared with the case of attaching the bucket 20, so that the angle characteristics equivalent to the case using the conventional parallel link can be obtained.

Therefore, the angle characteristics can be excellent in both cases where the bucket 20 is used and the fork 30 is used, and especially in the case of attaching the bucket 20, badly-dumping at the top position can be effectively prevented unlike the technology described in Patent document 3.

The angle characteristics when the fork 30 is replaced with the bucket 20 in Patent document 3 will be described below more concretely with reference to FIG. 5 (lower left). At first, the relation between the upper rotation angle of the bell crank and the length of the tilt cylinder when the fork 30 is attached at the ground position is expressed as a point V0.

On the other hand, when the bucket 20 is attached at the ground position, since the upper rotation angle of the bell crank is reduced by the offset amount of the angle alpha (FIG. 39), the relation with the length of the tilt cylinder is expressed as a point U0. Similarly, when the bucket is at the ground position, the relation between the lower rotation angle of the bell crank and the line segment PQ is expressed as a point V1 above the point V0 in the case of attaching the fork 30, and is expressed as a point U1 above the point U0 in the case of attaching the bucket 20. Further, the attachment angle against G. L. (ground level) when the bucket is on the ground is respectively expressed as points V2, U2 where the points V1, U1 are moved toward the left side, each of which is 0 degree.

Figure 39:
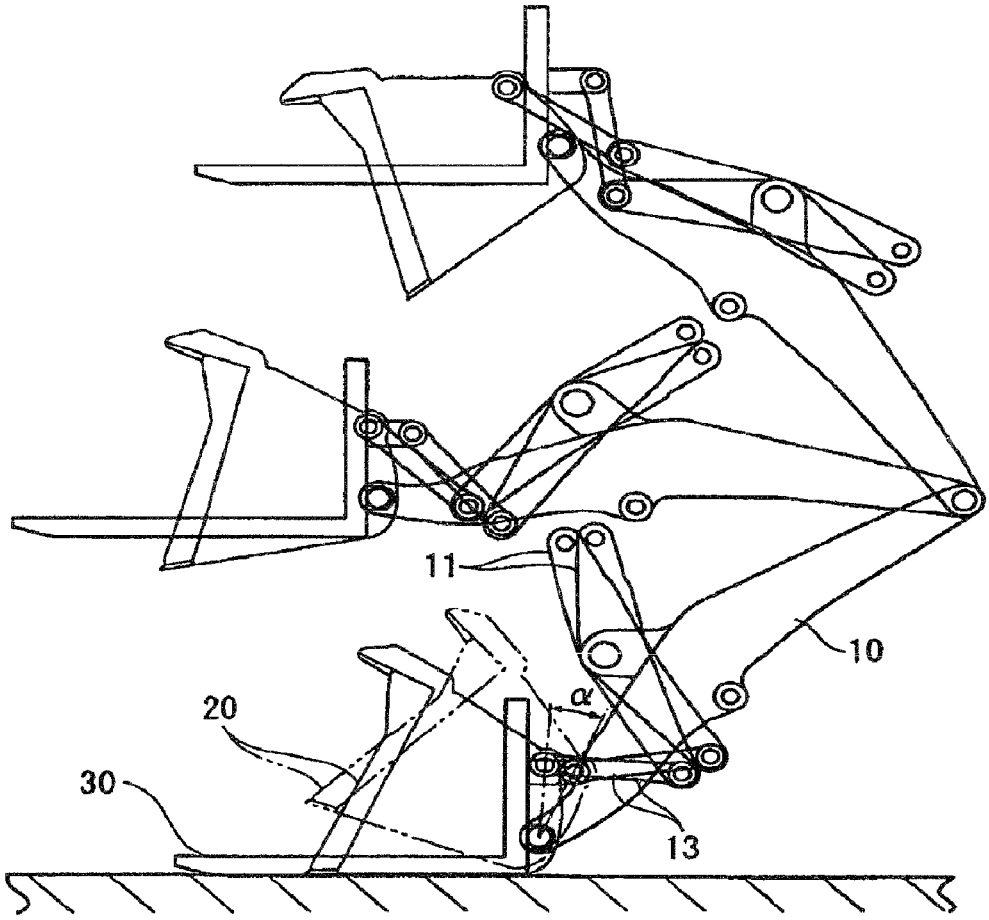
FIG. 39 Prior Art
FIG. 39 is further another view for illustrating movements of a further another working machine in the conventional technology.

Next, when the fork 30 and bucket 20 are lifted to the top position without changing the length of the tilt cylinder, the upper rotation angle of the bell crank is reduced from the points V0, U0 to the points V3, U3 respectively, as well as the lower rotation angle of the bell crank is reduced to the points V4, U4. The attachment angle against G. L. of the fork 30 in this state is, as expressed as a point V5 for the fork 30, 0 degree without changing from the ground position, while the attachment angle against G. L. of the bucket 20, as expressed as a point U5 for the bucket 20, is displaced by about −40 degrees, causing tilting significantly toward the dumping direction as shown in FIG. 39, where the angle characteristics is poor.

However, in the embodiment, the angle characteristics can be improved in both cases of using the bucket 20 (points T0 to T5 in FIG. 5) and using the fork 30 (points M0 to M5 in FIG. 5) to effectively prevent the bucket 20 from significantly dumping at the top position.

As described above, because an excellent characteristic of the Z-bar link and the parallel link can be obtained while using the Z-bar link, and an attachment such as the bucket 20 and the fork 30 can be appropriately selected for use, therefore only one wheel loader 3 is enough, which is more economical compared with the conventional case using two wheel loaders depending on the work type.

Figure 21:
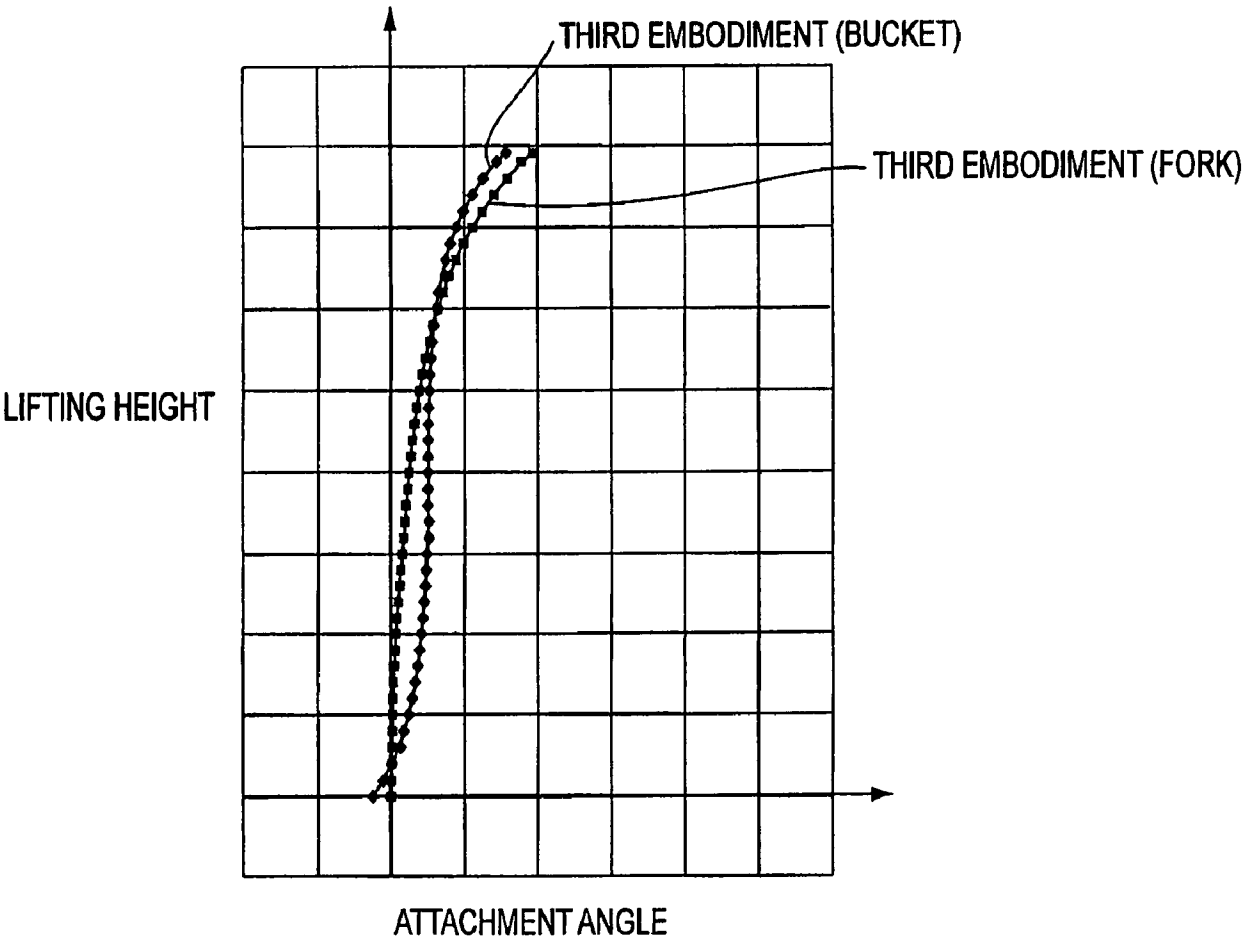
FIG. 21 is further another graph showing the angle characteristics of the third embodiment.

(8) Also in this embodiment, since the pivot position Z of the tilt cylinder 12 on the bottom side (vehicle body side) is disposed not on the boom 10 but on the structural body 16A, the pivot position Z can be appropriately set at a position where the displacement of the attachment angle of the bucket 20 or the fork 30 can be more reduced, and the angle characteristics can be also improved, so that the angle characteristics suitable for both the bucket 20 and the fork 30 can be obtained. Also, since the pivot position Z can be set with more flexibility, the best angle characteristics can be obtained corresponding to the required work by the setting of the pivot position Z. For instance, in this embodiment, the pivot position Z is set to have the angle characteristics shown in FIG. 20, but in such a case where the angle characteristics more close to the conventional parallel link shown in FIG. 20 is required, the pivot position Z can be easily set at the position where the required angle characteristics can be obtained, while the angle characteristics close to that of the parallel link can be easily obtained as shown in FIG. 21.

(9) Conventionally, in the wheel loader using the parallel link, there has been a case where simple digging work is desired by attaching the bucket to the parallel link, and an attachment for the purpose has been provided. In such case, the tilting force on the ground is smaller than that of the Z-bar link, so that not only working efficiency of the digging work is degraded but also another problem occurs in loading operation onto a vehicle at the top position.

Figure 22:
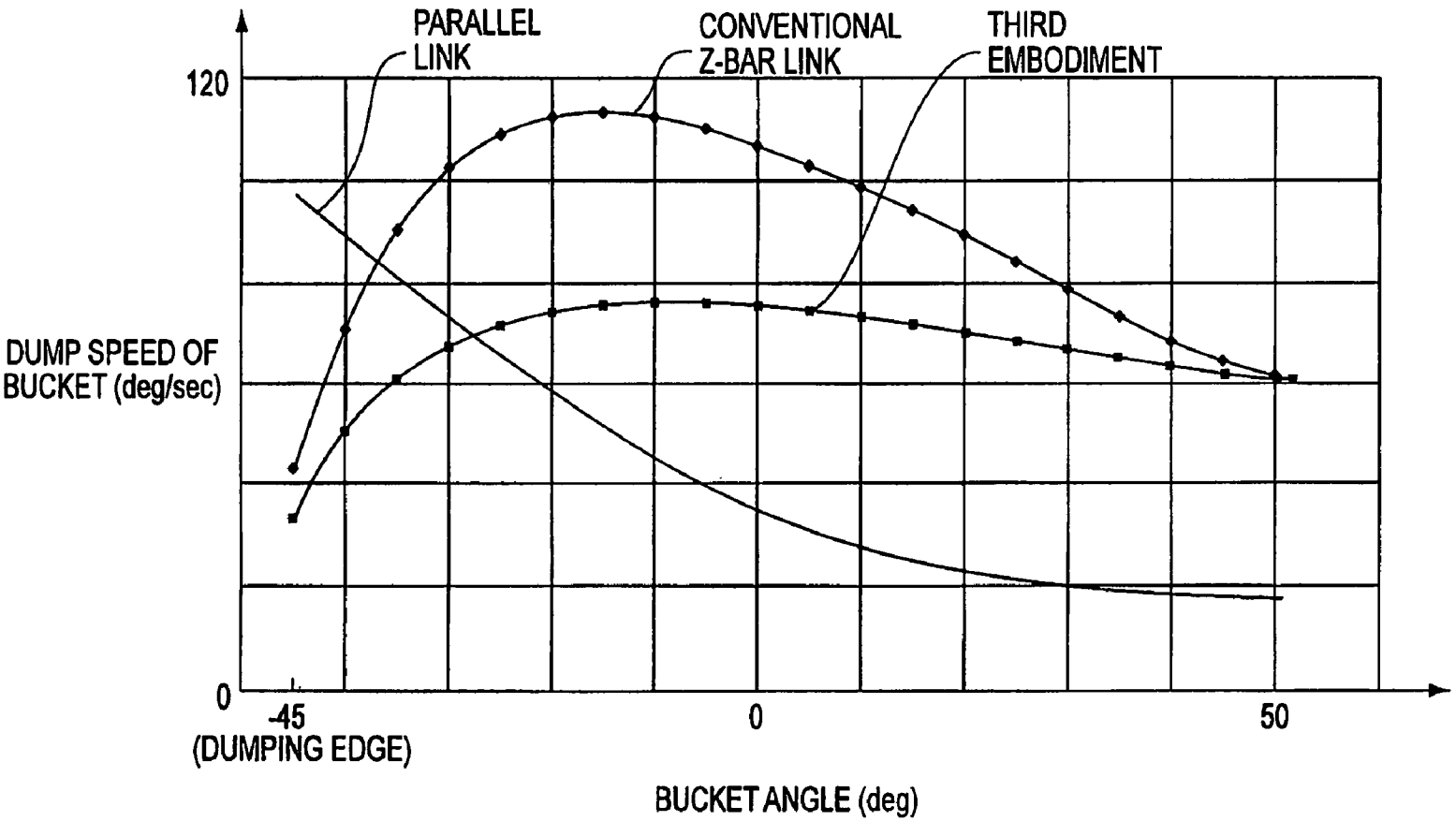
FIG. 22 is still further graph showing dump speed of the third embodiment.

As shown in FIG. 22, because of the mechanical characteristics of the Z-bar link, when dumping at the top position, the dump speed is fast in a large range of the angle, thereby the loading can be speedy performed, while because the relative angle between the first line segment L1 on the bell crank 11 and the connecting link 13 opens nearly to 180 degrees at around the maximum dumping, thereby the dump speed slows down, so that the shock at stroke end of a cylinder can be reduced without operating the cylinder. This effect is referred to as soft dump characteristics.

With the parallel link, overall the dump speed is slow. However, around the cylinder stroke end, the dump speed is sharply increased, producing a large shock, so that an operator is required to operate the cylinder speed to prevent load on the tilt cylinder or the like.

Regarding this problem, the Z-bar link is used as the basic configuration of the embodiment, where the soft dump characteristics is secured, not imposing a burden to the operator.

Thus, this embodiment can provide better performance in any terms of the digging ability on the ground, speed in loading work at the top, and the soft damp characteristic compared with those in the conventional method of attaching the bucket to the parallel link.

Figure 40:
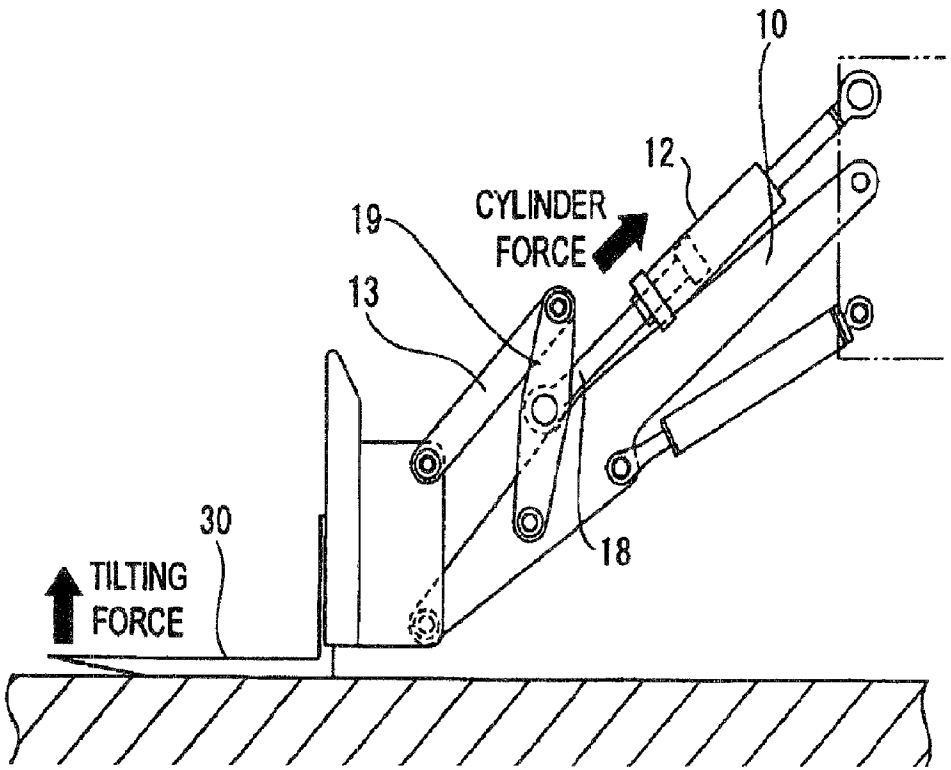
FIG. 40 Prior Art
FIG. 40 is a view for illustrating movements of a typical parallel link in the conventional technology.
Figure 41:
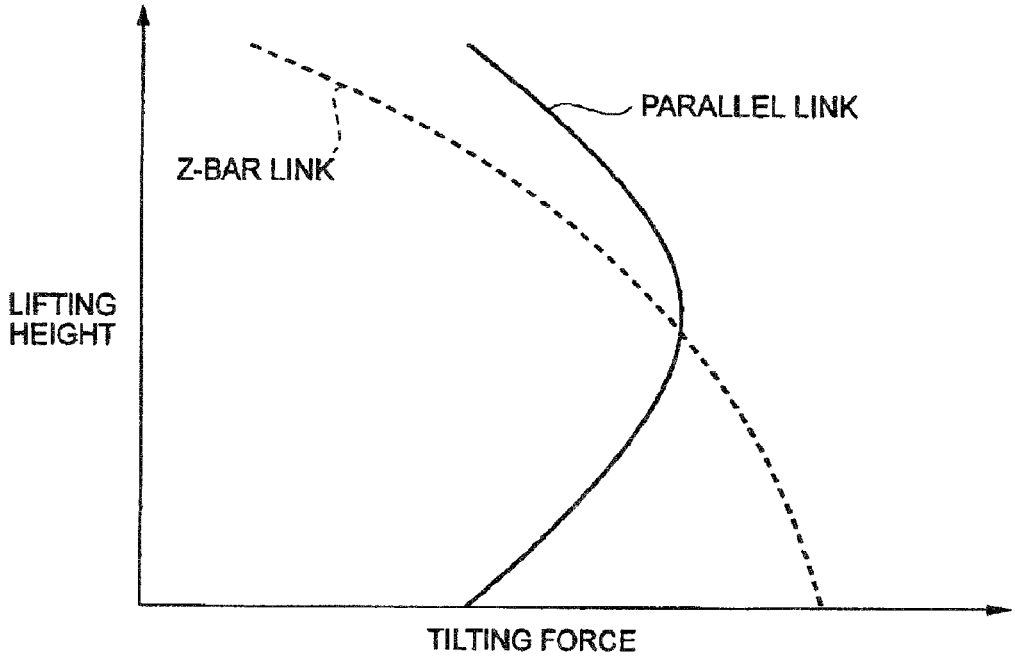
FIG.41 Prior Art
FIG. 41 is a view showing tilting force characteristics of a working machine.
Figure 42:
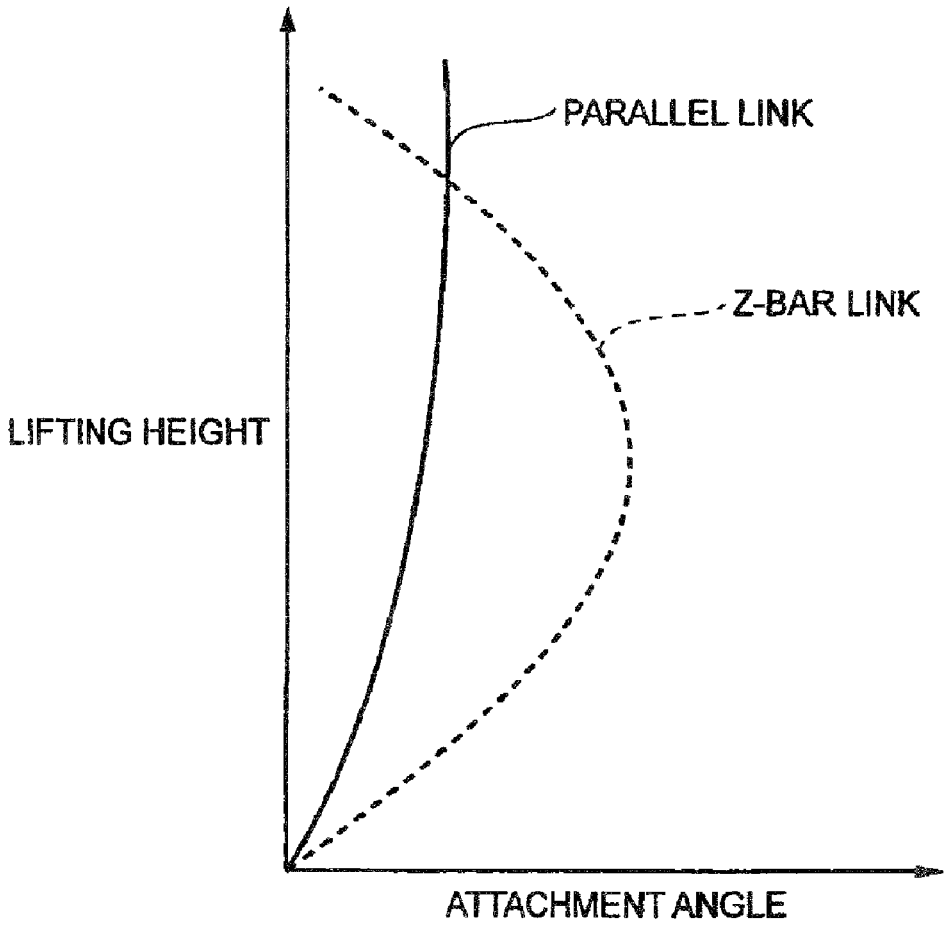
FIG. 42 Prior Art
FIG. 42 is a view showing angle characteristics of a working machine.

(10) In a case of using the fork 30 as an attachment, there is a problem that the tilt cylinder 12 needs to be large in size to obtain sufficient tilting force when attaching the fork 30 to the conventional parallel link. As shown in FIG. 40, with the parallel link, the tilting force of the fork 30 is generated by flowing hydraulic oil to the head side (bell crank 11 side) of the tilt cylinder 12 and pulling a cylinder rod 18, but in order to obtain the sufficient tilting force, it is necessary to secure a pressure accepting area with consideration of a cross-sectional area of the cylinder rod 18, thus the cylinder requires a larger diameter, resulting in a larger size.

On the other hand, in the wheel loader 2, the Z-bar link is used in the configuration, where the cylinder force and tilting force are generated by flowing the hydraulic oil or the like to the bottom side (vehicle body 16 side) of the tilt cylinder 12 and biasing in the direction of pressing the cylinder rod 18, so that, unlike the conventional parallel link (FIG. 40), the sufficient tilting force can be obtained by setting the pressure accepting area without consideration of the cross-sectional area of the cylinder rod 18. Therefore, the tilt cylinder 12 may be smaller in diameter compared with that in the case of the parallel link.

Fourth Embodiment

Figure 23:
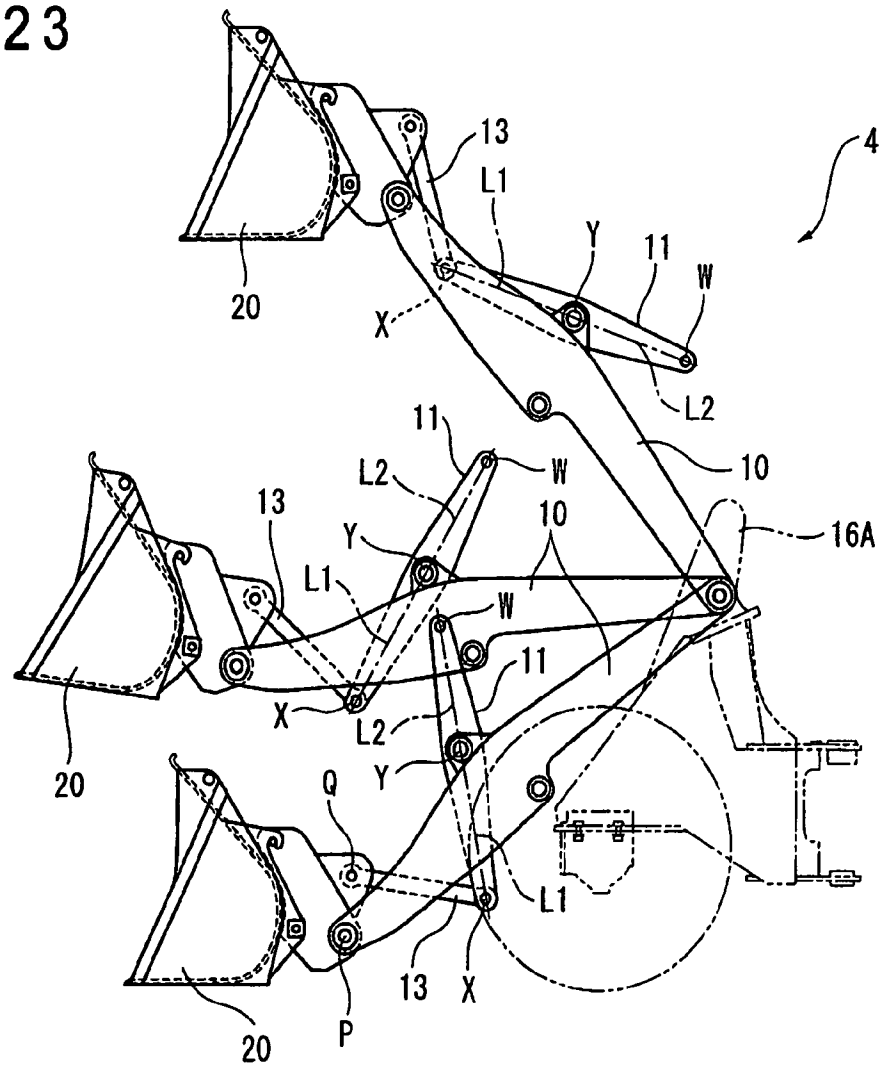
FIG. 23 is a view for illustrating movements of a working machine according to a fourth embodiment.
Figure 24:
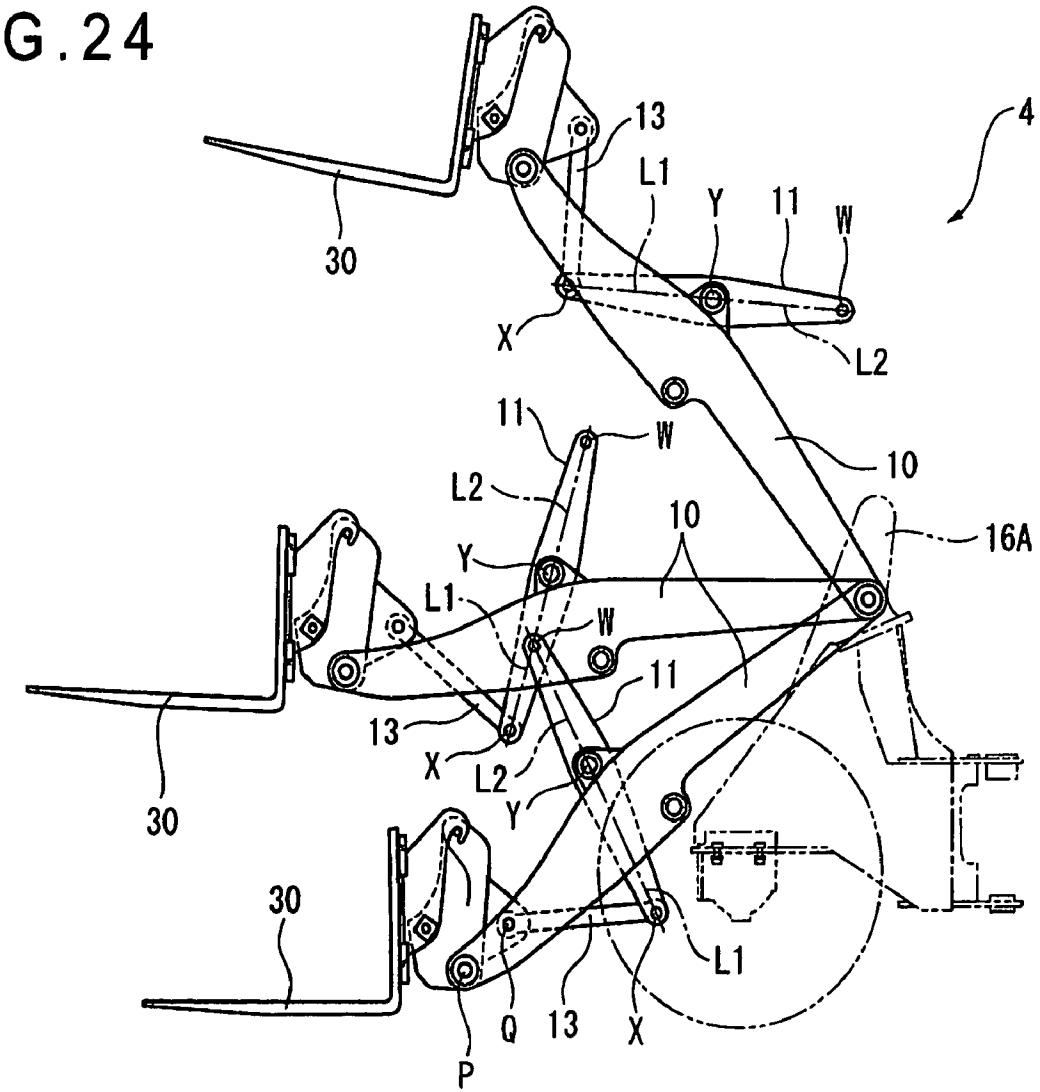
FIG. 24 is another view for illustrating the movements of the working machine of the fourth embodiment.

FIGS. 23 and 24 show an operation device of a wheel loader 4 according to a fourth embodiment of the present invention. FIG. 23 illustrates a state where the bucket 20 is equipped as an attachment, while FIG. 24 illustrates a state where the fork 30 is equipped as an attachment.

The wheel loader 4 according to the embodiment is characterized in that an angle between the first line segment L1 connecting a pivot position Y on the boom 10 and a pivot position X on the connecting link 13, and the second line segment L2 connecting the pivot position Y on the boom 10 and a pivot position W on the tilt cylinder (not shown) of the bell crank 11 is set to 180 degrees (i.e. the tilted angle is 0 degree).

Figure 25:
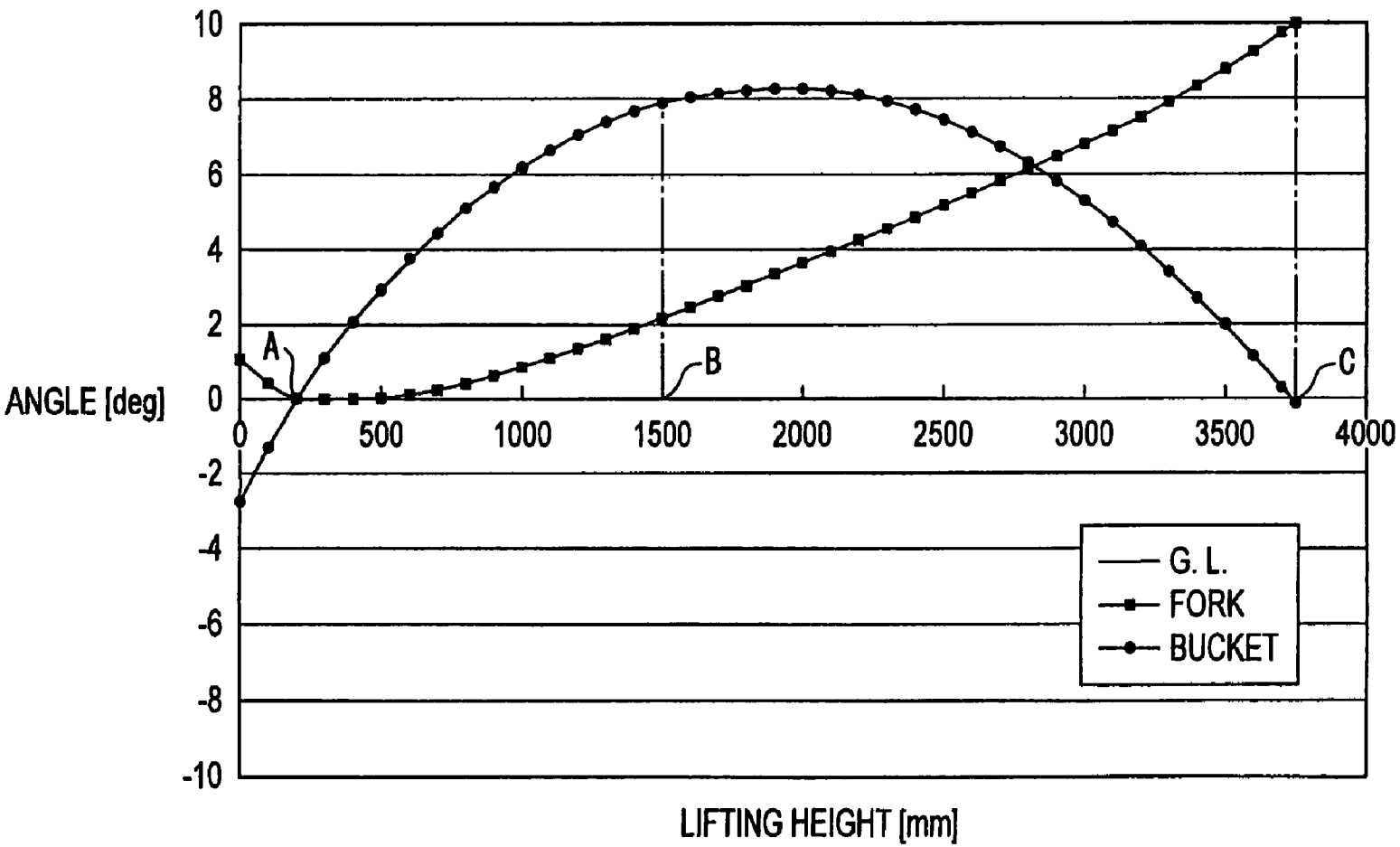
FIG. 25 is a graph showing angle characteristics of the fourth embodiment.

FIG. 25 shows lifting heights of the wheel loader 4 and postures of the bucket 20 and the fork 30 against the horizontal plane at each height (indicated by the angle). Incidentally, the lifting heights in the ascending order of FIGS. 23 and 24 are shown in FIG. 25 as the lifting heights A, B and C respectively.

As seen from FIG. 25, in the wheel loader 4 according to the embodiment, it is understood that the postures of the bucket 20 and the fork 30 do not significantly change depending on the lifting height, as described above.

Figure 26:
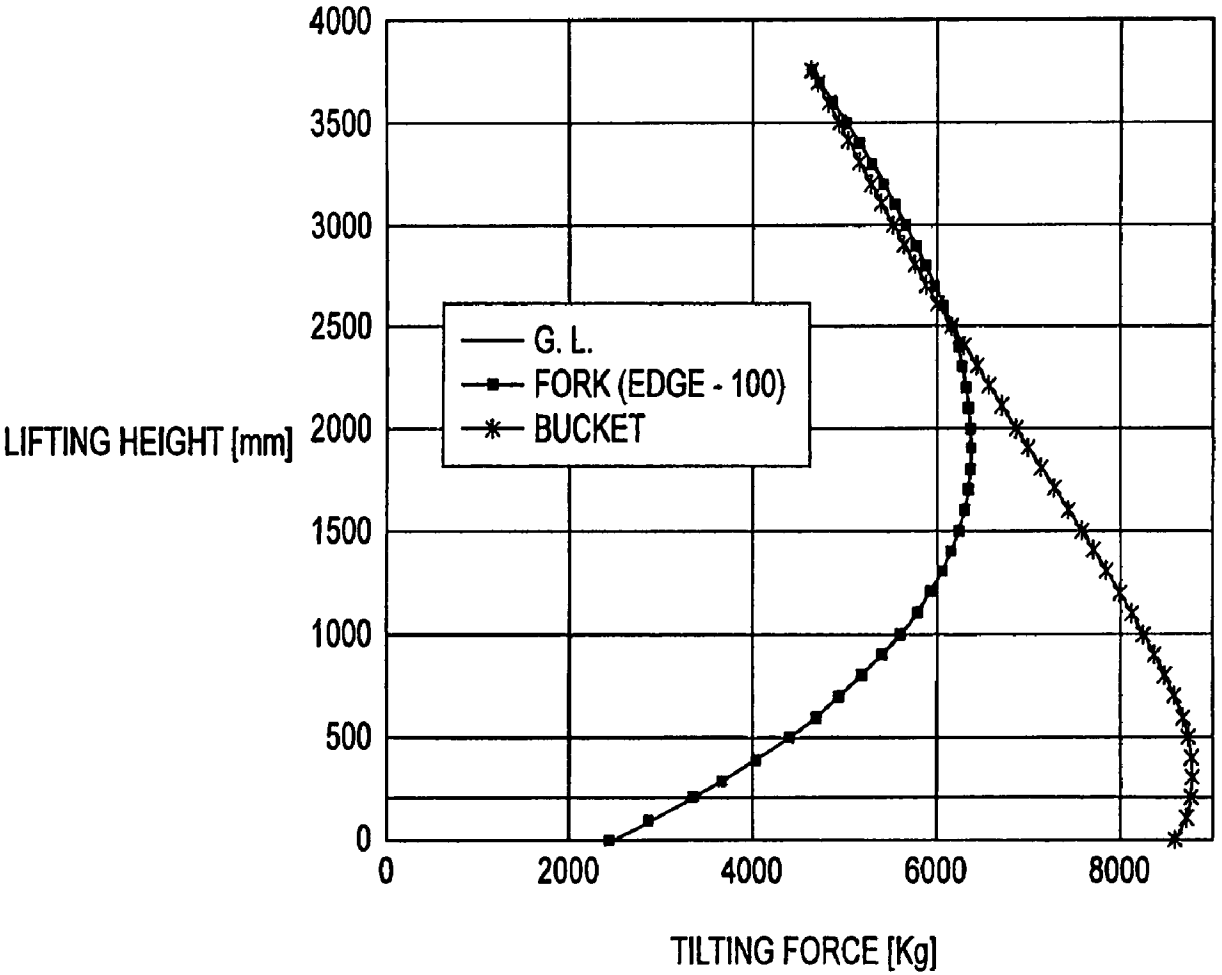
FIG. 26 is another graph showing tilting force characteristics of the fourth embodiment.

The tilting force characteristics are like those shown in FIG. 26, and in any case of using the bucket 20 or the fork 30, the tilting force characteristics allows no less than 4,000 kg tilting force even at the maximum lifting height of 3500 mm, ensuring that the lifting/unloading work of cargos can be appropriately performed by the fork 30 and working efficiency in the digging work by the bucket 20 at a low position is not reduced.

Such a shape shown of the bell crank 11 is preferred when the pivot position Q of the fork 30 is set at an offset angle no less than 37 degrees relative to the pivot position Q of the bucket 20.

Fifth Embodiment

Figure 27:
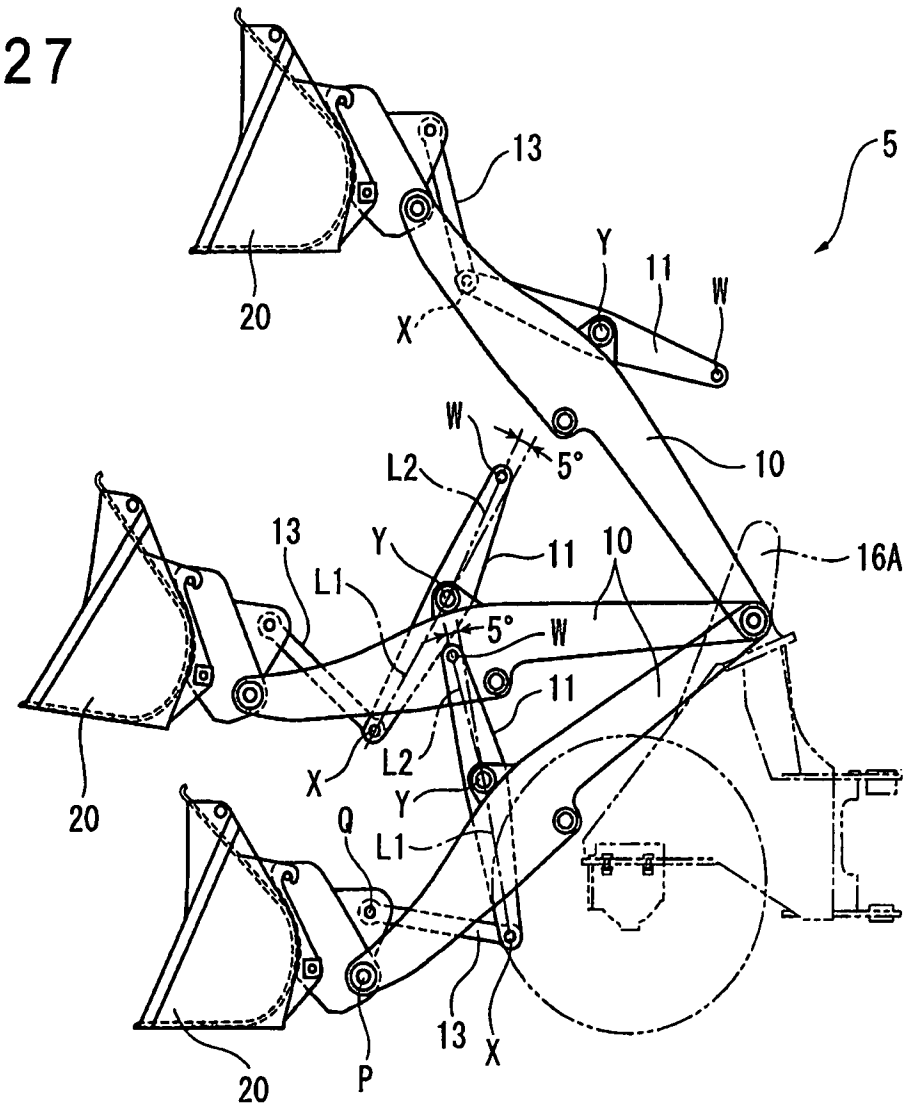
FIG. 27 is a view for illustrating movements of a working machine according to a fifth embodiment of the present invention.
Figure 28:
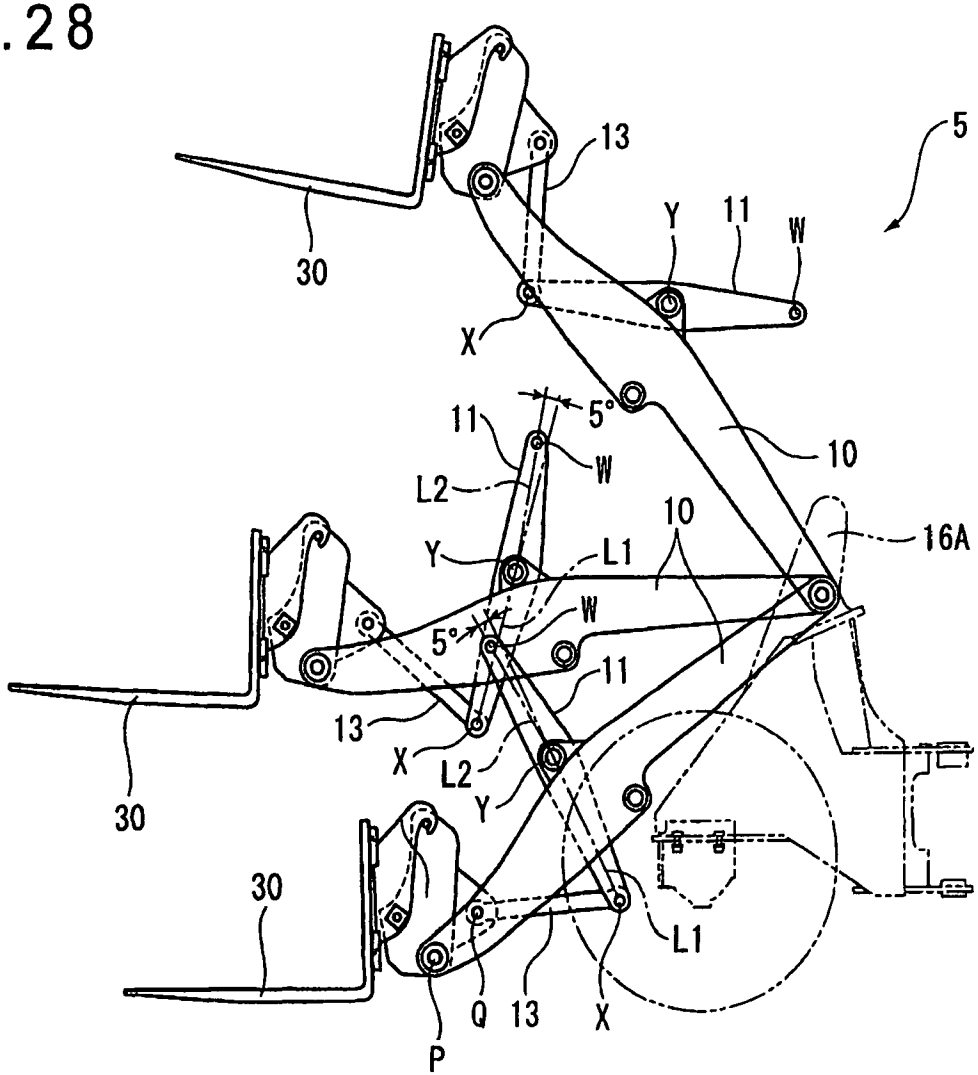
FIG. 28 is another view for illustrating the movements of the fifth embodiment.

FIGS. 27 and 28 show a work implement of a wheel loader 5 according to a fifth embodiment of the present invention. FIG. 27 illustrates a state where the bucket 20 is equipped as an attachment, while FIG. 28 illustrates a state where the fork 30 is equipped as an attachment.

The wheel loader 5 according to the embodiment is characterized in that an angle between the first line segment L1 connecting the pivot position Y on the boom 10 and the pivot position X on the connecting link, and the second line segment L2 connecting the pivot position Y on the boom 10 and the pivot position W on the tilt cylinder (not shown) of the bell crank 11 is set to 175 degrees (i.e. the tilted angle is 5 degrees).

Figure 29:
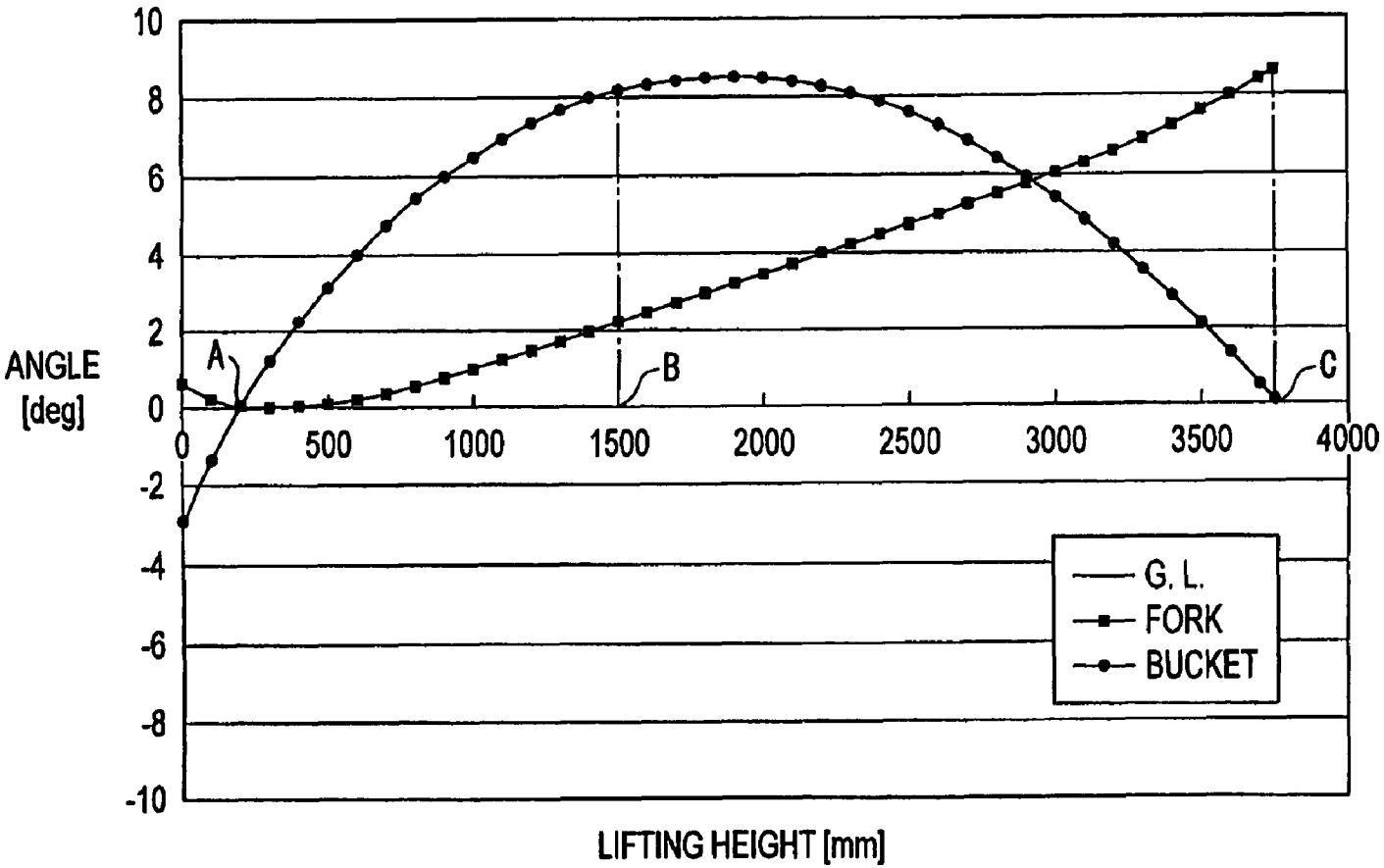
FIG. 29 is a graph showing angle characteristics of the fifth embodiment.

FIG. 29 shows lifting heights of the wheel loader 5 and postures of the bucket 20 and the fork 30 against the horizontal plane at each height (indicated by the angle). Incidentally, the lifting heights in the ascending order of FIGS. 27 and 28 are shown in FIG. 29 as the lifting heights of A, B and C respectively.

As seen from FIG. 29, in the wheel loader 5 according to the embodiment, it is understood that the postures of the bucket 20 and the fork 30 do not significantly change depending on the lifting height, and compared with the case of the wheel loader 4 of the fourth embodiment, the posture at the position C using the fork 3 is further improved from 10 degrees of the wheel loader 4 to 9 degrees with the wheel loader 5.

Figure 30:
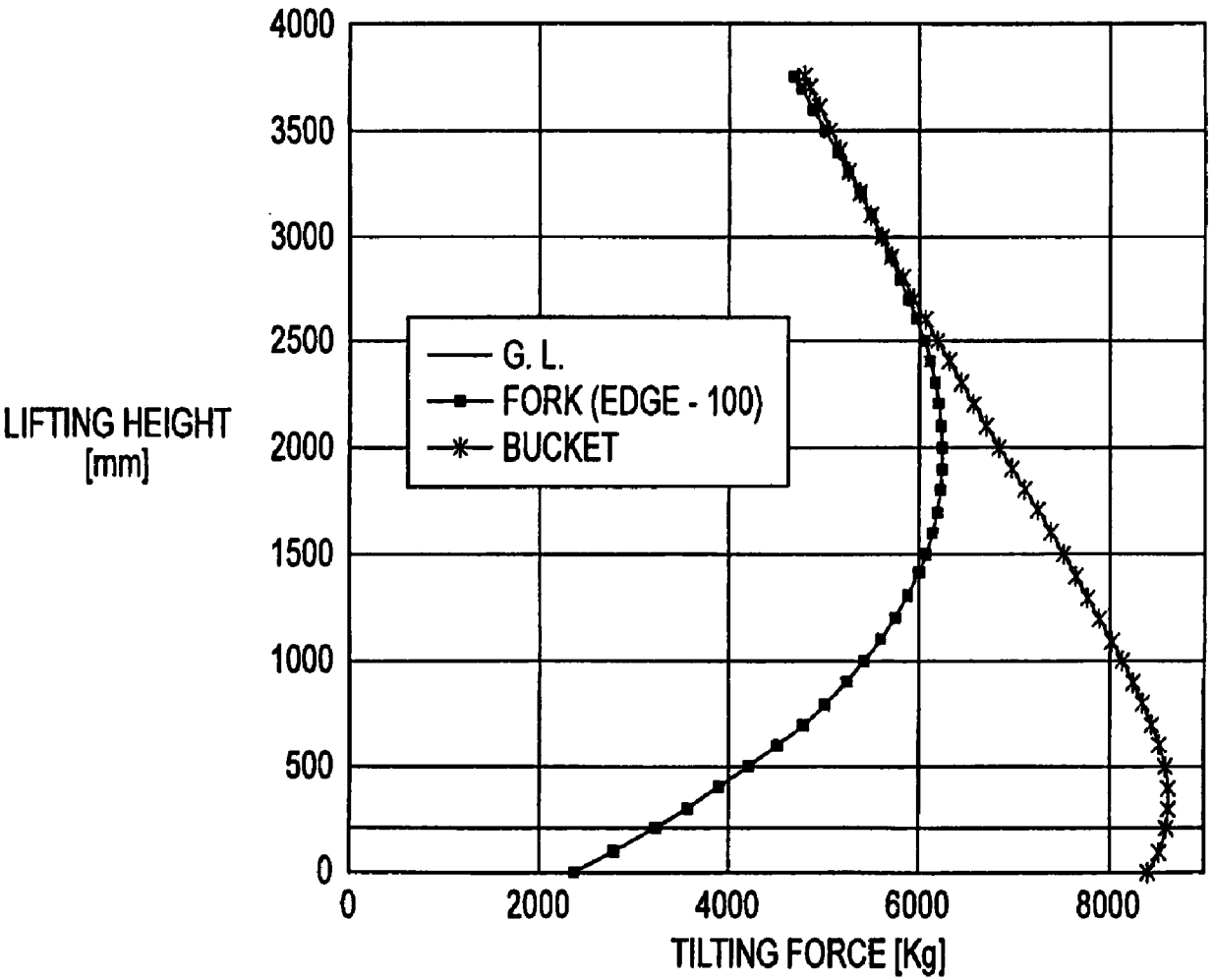
FIG. 30 is another graph showing tilting force characteristics of the fifth embodiment.

Furthermore, as shown in FIG. 30, the tilting force characteristics of the wheel loader 5 is substantially same as that of the wheel loader 4 of the fourth embodiment, ensuring that the lifting/unloading work of cargos can be appropriately performed by the fork 30 and working efficiency in the digging work by the bucket 20 at a low position is not reduced.

Such a shape shown of the bell crank 11 is preferred when the pivot position Q of the fork 30 is set at an offset angle no less than 37 degrees relative to the pivot position Q of the bucket 20.

Variants of Embodiments

The scope of the invention is not limited to the above-described embodiments but includes various variations and improvements in the design as long as an object of the present invention can be achieved.

Figure 31:
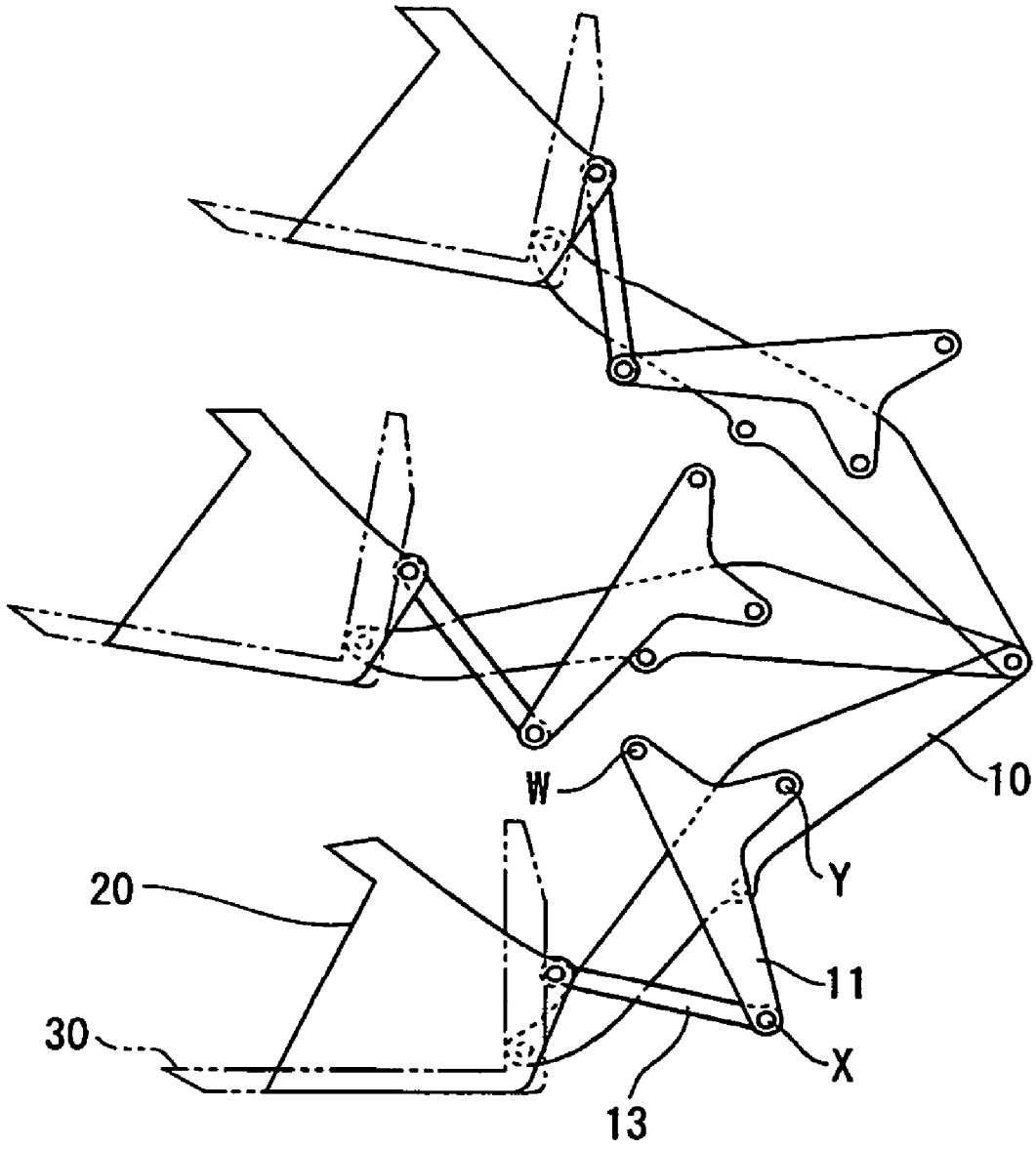
FIG. 31 is a view showing a first modification of the present invention.

For instance, the bell crank 11 disclosed in each of the embodiments generally has a dogleg-shape, but may have, for instance, a T-shape as shown in FIGS. 7, 8 according to the first embodiment and FIG. 31 (first variant), where the strength can be larger and the tilted angle can be set larger than the dogleg-shape. Namely, the shape of the bell crank 11 may be arbitrarily selected with consideration of the tilted angle, strength or the like.

Figure 32:
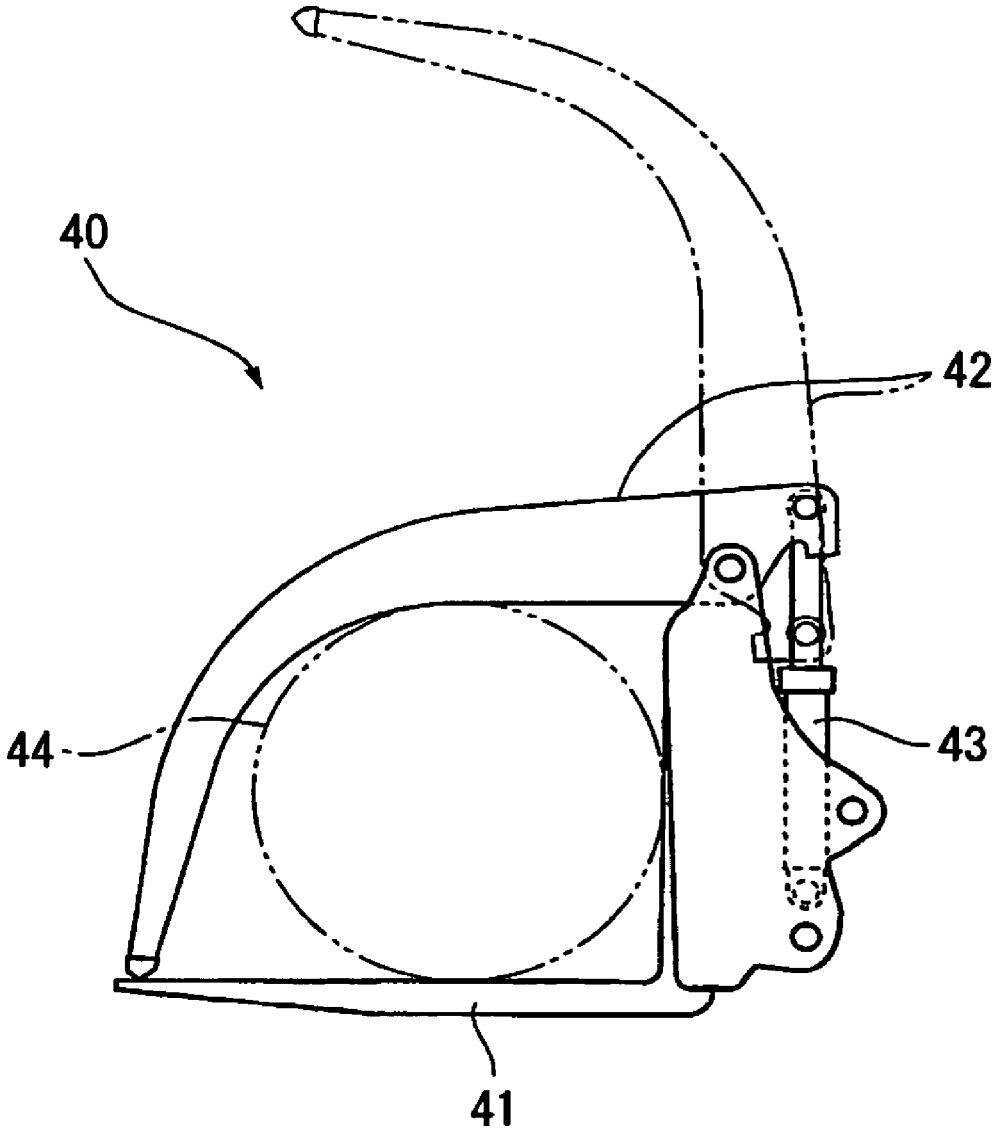
FIG. 32 is another view showing a second modification of the present invention.

In the third embodiment, the bucket 20 and the fork 30 are described as different attachments, but a net-like skeleton bucket (one of buckets or the like) may be used instead of the normal bucket 20, or a log/lumber grapple (one of forks or the like) may be used instead of the normal fork 30. FIG. 32 (second variant) shows the log/lumber grapple 40. The log/lumber grapple 40 includes a fork section 41 that is placed flat on the ground and a grapple 42 pivoted at the top end of a vertical portion of the fork section 41, in which the grapple 42 is driven (rotated and moved) by a hydraulic grapple cylinder 43.

The log/lumber grapple 40 is suitable for grabbing and carrying wood 44 such as raw wood. Naturally, the bucket or the like used in the present invention is not limited to the bucket 20 described in the first embodiment, and the fork or the like used in the present invention is not limited to the fork 30 described in the second embodiment, but the skeleton bucket, log/lumber grapple 40 or the like may be used.

Figure 33:
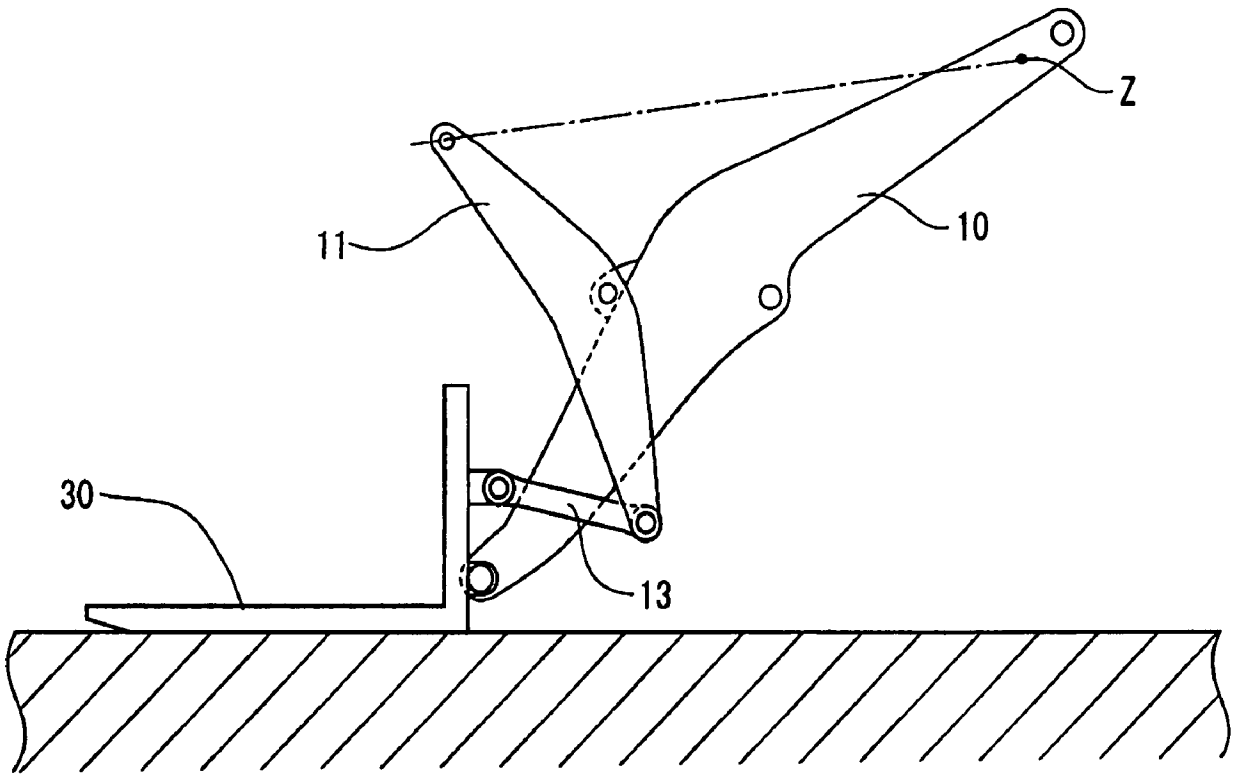
FIG. 33 is further another view showing a third modification of the present invention.
Figure 34:
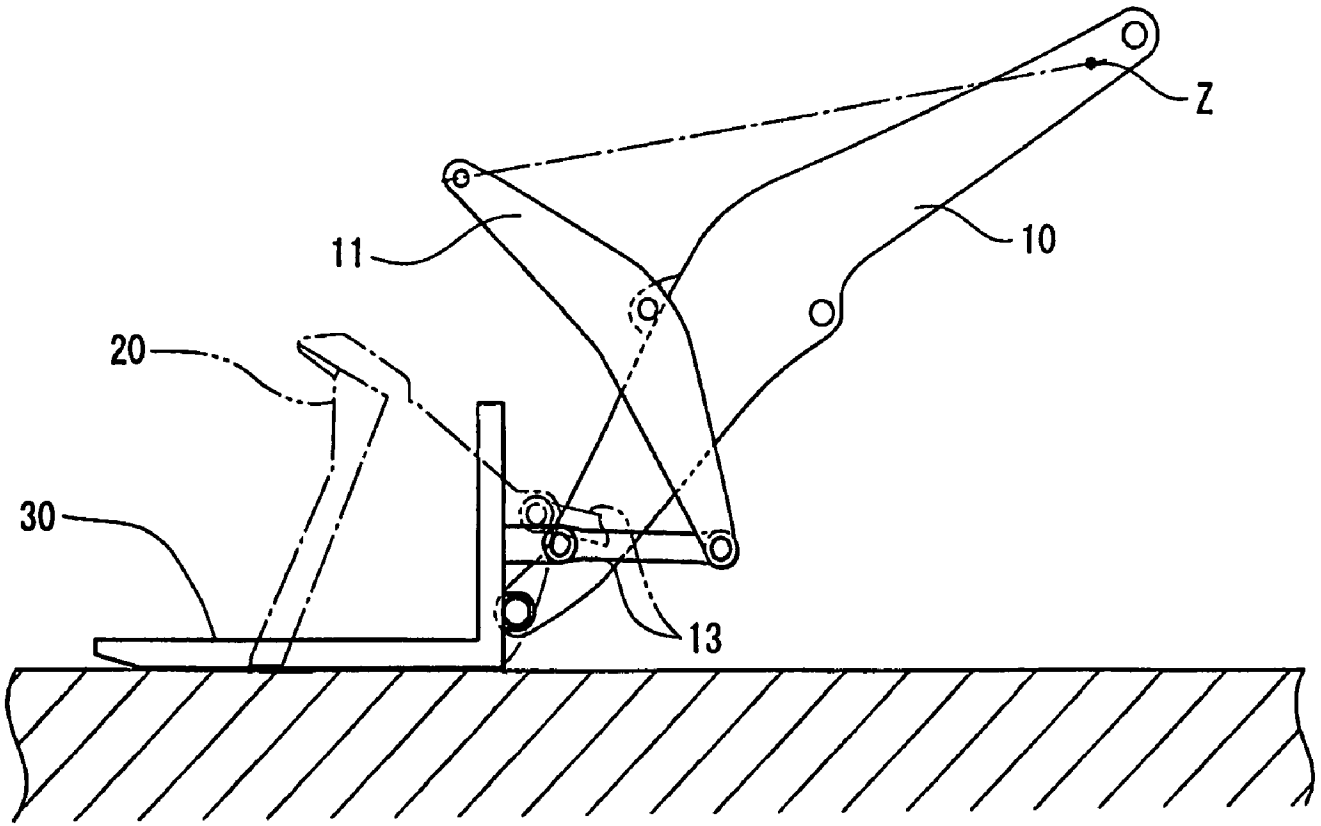
FIG. 34 is still further view showing a fourth modification of the present invention.

In each of the embodiments, the tilt cylinder 12 is pivoted on the vehicle body 16, but, as shown in FIG. 33 (third variant) and FIG. 34 (fourth variant), the cases where the tilt cylinder 12 is pivoted on the base end side of the boom 10 may be included in some embodiments of the invention.

Namely, in FIG. 33, the bell crank 11 is tilted toward the fork 30 side and the tilt cylinder 12 is pivoted on the boom 10. Furthermore, in FIG. 34, the pivot position Q of the fork 30 is disposed on the connecting link 13 in the offset state from the pivot position Q of the bucket 20 when the bucket 20 is horizontally pivoted. In such configurations, although the angle characteristics is not good, the tilting force characteristics can be sufficiently improved by using the bell crank 11 tilted toward the fork 30 side or by offsetting the fork 30.

In each of the embodiments, as shown in FIG. 2, the two booms 10 are pivoted on the structural body 16A and the bell crank 11 is disposed therebetween, but the present invention is not limited to this configuration. Namely, the present invention may be employed for a wheel loader having one box-like boom pivoted on the structural body 16A supporting the work implement and the bell crank pivoted at a middle position on an outer side face. In this case, the number of the bell crank is not limited to one but the bell cranks may be pivoted on both outer side faces, and further the tilt cylinder for driving the bell crank may be provided according to the number of the bell cranks.

The most preferable configuration for practicing the present invention or the like have been disclosed above, however, the present invention is not limited thereto. Namely, while particular embodiments of the present invention have been shown and described, changes and modifications may be made therein (e.g. in shape or other configuration details) by those skilled in the art without departing from scope of the invention.

Thus, the descriptions with some limitation in shape or the like are intended to be examples to help easy understanding of the present invention and is not to limit, in any way, the scope the present invention, and therefore, it is to be understood that any description of components in names without a part or all of limitations in shape or the like is included in the scoop of the present invention.

INDUSTRIAL APPLICABILITY

A working machine according to the present invention may be used not only as a wheel loader but also as any kind of construction machines, civil engineering machineries or the like without any limitation to self-traveling and stationary types.

The invention claimed is:

1. A working machine comprising:

a boom having a first end attached to a structural body;

an attachment attached to a second end of the boom;

a bell crank attached to a middle position of the boom in a longitudinal direction thereof;

a tilt cylinder having a first end pivotally supported on the structural body and a second end pivotally supported on an upper end of the bell crank when the attachment is horizontally at a ground position;

a boom cylinder having a first end pivotally supported on the structural body and a second end pivotally supported on the boom; and a connecting link for connecting a lower end of the bell crank and the attachment when the attachment is horizontally at a ground position, wherein:

an angle between a first line segment connecting a pivot position on the boom and a pivot position on the connecting link of the bell crank and a second line segment connecting the pivot position on the boom and a pivot position on the tilt cylinder of the bell crank is set in a range from 0 degrees to 180 degrees on the attachment side;

the attachment is one of a plurality of attachments;

each of the attachments is pivotally supportable at a different position by the connecting link with reference to a pivot position on the boom, the attachments include a bucket, the bucket being attached to the boom and the connecting link such that the bucket has different postures at the ground position including a horizontally supported posture and a tilted posture in which the bucket is tilted by the tilt cylinder, a pivot position of the tilt cylinder to the structural body is below a pivot position of the boom to the structural body, and a pivot position of the boom cylinder to the structural body is above a pivot position of the boom to the bell crank when the attachment is horizontally at a ground position, the bell crank is constructed and connected to the tilt cylinder and the boom, the tilt cylinder is constructed and connected to the bell crank and the structural body, and the boom is constructed and connected to the bell crank and the structural body to provide the attachment with the ground position, a top position and at least one intermediate position between the ground position and the top position in which the attachment, including the bucket with the different postures at the ground position, has the same posture in all of the ground position, the at least one intermediate position and the top position, the angle between the first line segment and the second line segment is set at an angle at which a sum of the attachment angle of the attachment at the at least one intermediate position and at the top position becomes substantially zero, and the bell crank is constructed and connected to the tilt cylinder and the boom, the tilt cylinder is constructed and connected to the bell crank and the structural body, and the boom is constructed and connected to the bell crank and the structural body such that the pivot position of the tilt cylinder to the bell crank is maintained radially outward of the pivot position of the boom to the bell crank at all of the ground position, the at least one intermediate position and the top position while the attachment has the same posture.

2. The working machine according to claim 1, wherein the angle between the first line segment and the second line segment is in a range from 0 degrees to 170 degrees.

3. The working machine according to claim 1, wherein the angle between the first line segment and the second line segment is in a range from 170 degrees to 180 degrees.

* * * * *